US006986682B1

(12) United States Patent
Jeon

(10) Patent No.: US 6,986,682 B1
(45) Date of Patent: Jan. 17, 2006

(54) HIGH SPEED CONNECTOR ASSEMBLY WITH LATERALLY DISPLACEABLE HEAD PORTION

(76) Inventor: Myoungsoo Jeon, 39422 Zacate Ave., Fremont, CA (US) 94539

( * ) Notice: Subject to any disclaimer, the term of this patent is extended or adjusted under 35 U.S.C. 154(b) by 0 days.

(21) Appl. No.: 11/128,149

(22) Filed: May 11, 2005

(51) Int. Cl.
*H01R 13/648* (2006.01)

(52) U.S. Cl. ..... 439/608; 439/65

(58) Field of Classification Search ..... 439/108, 439/65, 608, 701; 362/796
See application file for complete search history.

(56) References Cited

U.S. PATENT DOCUMENTS

| | | | | |
|---|---|---|---|---|
| 5,607,326 | A | 3/1997 | McNamara et al. | 439/608 |
| 5,702,258 | A | 12/1997 | Provencher et al. | 439/79 |
| 5,860,816 | A | 1/1999 | Provencher et al. | 439/79 |
| 5,980,321 | A | 11/1999 | Cohen et al. | 439/608 |
| 5,993,259 | A | 11/1999 | Stokoe et al. | 439/608 |
| 6,293,827 | B1 | 9/2001 | Stokoe | 439/608 |
| 6,299,483 | B1 | 10/2001 | Cohen et al. | 439/608 |
| 6,379,188 | B1 | 4/2002 | Cohen et al. | 439/608 |
| 6,409,543 | B1 | 6/2002 | Astbury, Jr. et al. | 439/608 |
| 6,503,103 | B1 | 1/2003 | Cohen et al. | 439/608 |
| 6,506,076 | B2 | 1/2003 | Cohen et al. | 439/608 |
| 6,517,360 | B1 | 2/2003 | Cohen | 439/65 |
| 6,554,647 | B1 | 4/2003 | Cohen et al. | 439/607 |
| 6,602,095 | B2 | 8/2003 | Astbury, Jr. et al. | 439/608 |
| 6,607,402 | B2 | 8/2003 | Cohen et al. | 439/608 |
| 6,641,410 | B2 | 11/2003 | Marvin et al. | 439/83 |
| 6,663,426 | B2 * | 12/2003 | Hasircoglu et al. | 439/608 |
| 6,663,442 | B1 | 12/2003 | Helster et al. | 439/751 |
| 6,709,294 | B1 | 3/2004 | Cohen et al. | 439/608 |
| 6,739,918 | B2 | 5/2004 | Cohen et al. | 439/701 |
| 6,764,349 | B2 | 7/2004 | Provencher et al. | 439/701 |
| 6,776,659 | B1 | 8/2004 | Stokoe et al. | 439/608 |
| 6,780,059 | B1 | 8/2004 | Payne et al. | 439/608 |
| 6,786,771 | B2 | 9/2004 | Gailus | 439/608 |
| 6,808,399 | B2 | 10/2004 | Rothermel et al. | 439/108 |
| 6,808,420 | B2 | 10/2004 | Whiteman, Jr. et al. | 439/608 |
| 6,814,619 | B1 | 11/2004 | Stokoe et al. | 439/608 |
| 6,817,868 | B2 | 11/2004 | Matsuo et al. | 439/65 |
| 6,827,611 | B1 | 12/2004 | Payne et al. | 439/608 |
| 6,851,980 | B2 | 2/2005 | Nelson et al. | 439/608 |

(Continued)

OTHER PUBLICATIONS

"HX2 series—High Speed and High Density Connectors for 10Gbps Backplane System", by Hirose Electronics Co. Ltd, revision 1.0, 10 pages (Sep. 12, 2003).

*Primary Examiner*—Michael C. Zarroli
(74) *Attorney, Agent, or Firm*—Silicon Edge Law Group LLP; T. Lester Wallace; Darien K. Wallace

(57) ABSTRACT

A high speed connector assembly includes a first surface-mount connector (SMC) and a second SMC. The first SMC includes a first flexible printed circuit (FPC) that has conductors that extend from a first FPC edge to a second FPC edge. The first edge includes surface-mount contact structures for surface mounting to a first printed circuit board. The second SMC includes a second FPC that has conductors that extend from a first FPC edge to a second FPC edge. The first edge includes surface-mount contact structures for surface mounting to a second printed circuit board. A set of contact beams is disposed along the second FPC edge. The first and second SMCs are mateable such that the contact beams make electrical contact between conductors in the first FPC and conductors in the second FPC. The FPC of the second SMC flexes to adjust for misalignments between the first and second SMCs.

20 Claims, 17 Drawing Sheets

U.S. PATENT DOCUMENTS

| | | | | |
|---|---|---|---|---|
| 6,866,549 | B2 | 3/2005 | Kimura et al. | 439/701 |
| 6,872,085 | B1 | 3/2005 | Cohen et al. | 439/108 |
| 2001/0005654 | A1 | 6/2001 | Cohen et al. | |
| 2002/0098727 | A1 | 7/2002 | McNamara et al. | |
| 2002/0111069 | A1 | 8/2002 | Astbury, Jr. et al. | |
| 2004/0224559 | A1 * | 11/2004 | Nelson et al. | 439/608 |
| 2005/0020134 | A1 * | 1/2005 | Winings et al. | 439/608 |

* cited by examiner

HIGH SPEED CONNECTOR ASSEMBLY WITH LATERALLY DISPLACEABLE HEAD PORTION

TECHNICAL FIELD

The present invention relates generally to high speed connectors.

BACKGROUND INFORMATION

Electrical connectors are used in electronic equipment and devices to communicate electrical signals from one printed circuit board to another. As operating speeds of the electronics of such electronic equipment and devices have increased, the communication of the electrical signals in a noise-free fashion has become more important and more difficult to achieve. If, for example, an electrical signal is transmitted down a conductor and if there are discontinuities in the characteristic impedance of the conductor, or if the conductor is not properly terminated, then electrical reflections may be generated. These reflections are undesirable and may obscure the desired signal that was to be conducted down the conductor. If, for example, two conductors extend parallel and close to one another for a long distance, a signal propagating down one of the conductors may induce a signal into the other conductor. Again, the induced signal is undesirable and may obscure a desired signal that was to be conducted down the other conductor. If, for example, an adequately long segment of a conductor is left unshielded and if a high frequency signal is present on the segment, then the segment may act as an antenna and radiate electromagnetic radiation or receive electromagnetic radiation. This is undesirable as well. As the operating speeds of the electronics within the electronic equipment and devices have increased over time, the need to minimize reflections, crosstalk and the radiation of electromagnetic energy in the conductors within electrical connectors has become more important.

FIG. 1 (Prior Art) is a simplified perspective view of a piece of electronic equipment 1 such as a router or computer. Equipment 1 includes a first printed circuit board 2 extending in a first plane and a second printed circuit board 3 extending in a second plane perpendicular to the first printed circuit board. The first printed circuit board is often referred to as a motherboard or a backplane. The second printed circuit board is often referred to as a daughterboard or line card or expansion board. Although not illustrated in FIG. 1, there are typically many daughterboards within the piece of electronic equipment.

Electrical signals are communicated between first printed circuit board 2 and second printed circuit board 3 across a right angle connector assembly. The connector assembly includes a first connector 4 disposed on the motherboard and a second connector 5 disposed on the daughterboard. The first connector 4 is often referred to as the motherboard connector and the second connector 5 is often referred to as the daughterboard connector. The assembly is called a right angle connector because the two printed circuit boards are disposed at right angles with respect to one another.

FIG. 2 (Prior Art) is an expanded perspective view of motherboard 2, motherboard connector 4, daughterboard 3, and daughterboard connector 5. To couple the daughterboard to the motherboard, the daughterboard is moved with respect to the motherboard in the direction of arrow 6 such that female daughterboard connector 5 mates with male motherboard connector 4. Individual signal conductors within daughterboard connector 5 are thereby coupled to corresponding individual signal conductors within motherboard connector 4.

FIG. 3 (Prior Art) is a cross-sectional diagram showing how motherboard connector 4 is mechanically and electrically coupled to motherboard printed circuit board 2. Daughterboard connector 5 is coupled to daughterboard 3 in similar fashion. Motherboard connector 4 is a male connector that includes an insulative housing 7 and a plurality of metal pins 8 and 9. Each pin has a first end for mating with female daughterboard connector 5 and a second press-file contact tail end. Each press-fit contact tail extends into a corresponding through hole in the printed circuit board. There are two press-fit contact tails 10 and 11 illustrated in FIG. 3. Each contact tail has a hollow eye which allows the contact tail to be compressed by the sidewalls of the through hole as the contact tail is forced into the through hole when connector 4 is fixed to motherboard 2. The contact tail presses back out against the sidewalls of the through hole and thereby holds the contact tail and pin in place. All the contact tails of the all the pins in turn hold the connector 4 in place on the printed circuit board.

FIG. 4 (Prior Art) is an end view of male motherboard connector 4. Insulative housing 7 includes a first sidewall portion 12 and a second sidewall portion 13. The ends of pairs of numerous signal pins are seen extending upward toward the viewer from the plane of the page. Pins 8 and 9 are one such pair. The signal pins are disposed in pairs because differential electrical signals are conducted over the signal conductors. The electric signal being communicated is a differential signal between a signal on the first signal pin of the pair and the second signal pin of the pair.

In addition to pairs of signal pins, a plurality of vertically oriented ground strips 15 is illustrated. Each ground strip includes a set of press-fit contact tails. The contact tails extend into through holes in the printed circuit board and make electrical contact with a ground plane in printed circuit board 2. In the illustration of FIG. 4, the opposite strip bar side of each ground strip is seen extending upward toward the viewer from the plane of the page. The contact tails (not seen) of the ground strip extend into the plane of the page. Motherboard connector 4 is made by inserting the signal pins and ground strips into accommodating holes and slots in insulative housing 7. See U.S. Pat. No. 6,872,085 for additional details.

To facilitate the design of transmission lines having constant characteristic impedances, signal conductors and dielectrics and ground planes are realized that have preset physical forms and orientations with respect to one another. One such set of forms and orientations is illustrated in cross-section in FIG. 5 (Prior Art). The signal conductors 16 and 17 within the dielectric 18 of a printed circuit board are disposed between two ground planes 19 and 20. In the diagram, two coupled stripline conductors 16 and 17 extend parallel to one another into the plane of the page.

FIG. 6 (Prior Art) illustrates another form and orientation called microstrip. In this form and orientation, there is one ground plane 20 disposed on one side of a pair of signal conductors 21 and 22, and the signal conductors are embedded in dielectric material 23 of the printed circuit board.

The stripline and microstrip forms of signal conductors, dielectric and ground planes are employed in the design of male motherboard connector 4 of FIG. 4. Note the similarity in appearance between the ground strips and signal conductor pins of the connector of FIG. 4 and the ground planes and signal conductors of the printed circuit boards of FIGS. 5 and 6.

FIG. 7 (Prior Art) is a simplified cross-sectional diagram that shows the female daughterboard connector 5 aligned with respect to the male motherboard connector 4. Female daughterboard connector 5 includes an insulative housing 24 and a set of signal conductors. Signal conductor 25 is referred to as an example. Signal conductor 25 terminates at one end in a press-fit contact tail 26 that extends into an associated through hole in the printed circuit board of daughterboard 3. Signal conductor 25 terminates at the other end in a pair of contact beams 27. When the two connectors 4 and 5 of the assembly are mated, pin 8 of male connector 4 extends through a hole 29 in insulative housing 24 and slidingly engages contact beams 27 so as to make electrical contact with signal conductor 25. Once mated, an electrical signal can pass from a conductor (not shown) within motherboard 2, through the contact tail 10 of pin 8 of motherboard connector 4, through pin 8 and to contact beams 27 of signal conductor 25, through signal conductor 25 in daughterboard connector 5, through the contact tail 26 and into a signal conductor (not shown) within daughterboard printed circuit board 3.

Daughterboard connector 5, in one embodiment, is made of multiple "wafers". See U.S. Pat. No. 6,872,085 for further details. The signal conductors of one such wafer are illustrated in FIG. 7.

FIG. 8 (Prior Art) is an exploded view of one wafer. The wafer includes a shield plate of metal 31, insulative housing 24 and signal conductors 33. Signal conductor 25 is one of signal conductors 33. The metal signal conductors can be made by stamping them out of a metal plate. The metal plate is typically a thick, approximately 0.2 millimeter thick, stiff sheet of copper or copper alloy. The stamped metal signal conductors 33 are pressed into accommodating slots in insulative housing 24. Similarly, shield plate 31 can be stamped out of a sheet of metal and can be pressed into an accommodating recess in insulative housing 24. Many such wafers are stacked together so that the holes (for example, hole 29) in the insulative housings of the wafers align to form a two-dimensional matrix of holes. The stack of wafers is held together in place by a conductive stiffener clip (not shown). See U.S. Pat. No. 6,872,085 for further details.

Although this type of connector assembly works well in many environments, there exist problems in certain applications due to mismatches between connectors when motherboard and daughterboard connectors are brought together when printed circuit boards of electronic equipment are to be connected to one another. FIG. 9 (Prior Art) illustrates one such problem. Due to shortcomings in some printed circuit board fabrication techniques, a separation 28 between two daughterboard connectors 5 and 34 may vary in a range of plus or minus 0.1 millimeters. Similarly, a separation 30 between two motherboard connectors 4 and 35 may also vary in a range of plus or minus 0.1 millimeters. When daughterboard 3 and motherboard 2 are brought together, there can be a significant mismatch between connectors of each connector assembly. When the connectors are mated, the misalignment gives rise to mechanical stress between the connectors and the printed circuit boards to which they are attached. This mechanical stress must be absorbed satisfactorily without breaking the connectors or structures by which the connectors are attached to the printed circuit boards.

FIG. 10 (Prior Art) is a cross-sectional diagram illustrating such stress. The pin that extends downward and terminates in contact tail 36 is strong and absorbs stress due to connector 37 being pushed in the direction of arrow 38 with respect to printed circuit board 39 being pushed in direction of arrow 40. As signal frequencies increase, however, the length of such a contact tail and the associated plated through hole and the irregular shape and discontinuous electrical characteristics of the contact tail and plated through hole cause electrical reflections, cross-talk and/or electromagnetic radiation. Although strong and reliable, the structure of FIG. 10 is undesirable due to its electrical characteristics.

FIG. 11 (Prior Art) is a simplified cross-sectional diagram of an alternative structure wherein connector 37 is surface mounted to printed circuit board 39. A solder ball or surface mount connector pin 41 on connector 37 is soldered to a solder pad 42 on printed circuit board 39 by a solder joint 43. This structure does not have the irregularly shaped contact tail of FIG. 10, but the structure does have a somewhat long and conductive plated through hole 44. Plated through hole 44 may act as an antenna is an undesirable way. To help avoid this problem, a backdrilling step may be employed to remove much of the plated through hole 44. The dashed line 45 in FIG. 12 (Prior Art) illustrates the hole that results after back drilling.

FIG. 13 (Prior Art) illustrates another structure wherein expensive back drilling step is not needed. In the structure of FIG. 13, stacked blind vias or conductive plugs 46, 47 and 48 are built into printed circuit board 39 to connect surface mounted connector 37 to electrical conductor 49 within printed circuit board 39. Although it may be desired to be able to have the improved electrical properties of the surface mount structures of FIGS. 11–13 in a connector assembly design, stress due to the misalignment of connectors may cause solder joints between connector 37 and printed circuit board 39 to fail. The stress may lift the solder pad 42 off printed circuit board 39. It is therefore difficult or impossible to employ the surface mount techniques in high speed connector assemblies involving many signal pairs where there may be multiple connectors on each printed circuit board. An improvement upon the connector assembly structure of U.S. Pat. No. 6,872,085 is desired.

SUMMARY

A high speed connector assembly includes a first surface-mount connector and a second surface-mount connector. The first connector may, for example, be a male motherboard connector. The first connector includes a first printed circuit (PC) portion that has a plurality of signal conductors. Each signal conductor extends from a location proximate to a first PC edge to a location proximate to a second PC edge. The first edge includes surface-mount contact structures for making connection with a printed circuit board.

The second surface-mount connector may, for example, be a female daughterboard connector. The second surface-mount connector includes a second PC portion. The second PC portion has a plurality of signal conductors. Each signal conductor extends from a location proximate to the first PC edge of the second PC to a second PC edge of the second PC portion. The first edge includes surface-mount contact structures for making connection with a second printed circuit board. A set of contact beams is disposed along the second PC edge such that there is a single contact beam coupled to the second edge end of each signal conductor in the second PC portion.

The first and second surface-mount connectors are mateable such that when the second edge of the PC portion of the first connector is pushed-into the second connector, the contact beams on the second edge of the second connector make electrical contact between signal conductors of the PC portion in the first surface-mount connector and corresponding signal conductors of the PC portion in the second surface-mount connector.

In some embodiments, the PC portion of the second surface mount connector is a flexible printed circuit (FPC) portion. The FPC portion is more flexible than a typical printed circuit board of similar dimensions and has a tensile modulus of five GPa or less. The FPC portion can flex to adjust for misalignments between the first and second connectors.

The second connector in one embodiment includes a head portion and a body portion, wherein the FPC portion extends from the body portion to the head portion. The FPC portion flexes so that the head portion is laterally displaceable with respect to the body portion.

By allowing the head portion of the second connector to be laterally displaceable with respect to the body portion of the second connector, the connector assembly can prevent stress from being transferred to the surface-mount connections between the first connector and the first printed circuit board and between the second connector and the second printed circuit board. By preventing or reducing this stress, damage to the surface mount connector-to-printed circuit board connections is reduced or avoided. Relatively fragile solder surface mount techniques and structures can therefore be employed to couple the connectors to their respective printed circuit boards without unacceptable high failure rates of the surface mount joints.

The contact beam and conductor structure of the mating PC portions in the connector assembly is fashioned to shield signal conductors and signal contact beams with ground conductors. By having a PC portion signal conduction path in one connector and a PC portion signal conduction path in the second connector, the same PC materials and conductor dimensions and ground planes are provided in both connectors. Changes in the characteristic impedance of the signal path as the signal path extends from one connector to the other connector is reduced, thereby reducing unwanted reflections. By using surface-mount structures (for example, solder balls or metal surface mount contacts) to surface-mount the first edges of the PC portions to their respective printed circuit boards, unwanted extending plated through holes need not be used in the printed circuit board. The extending conductors of contact tails of press-fit pins are also avoided. The associated cross-talk and electromagnetic radiation and reception due to extending plated through holes and contact tails are therefore eliminated due to the use of surface-mount connections to the printed circuit boards.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

FIG. 22 also includes an expanded view of the FPC portions within the motherboard connector.

FIG. 23 also includes an expanded view of the solder balls on the bottom surface the connector.

FIG. 27 includes an expanded view of the contact beams on the FPC portions of the daughterboard, where the contact beams make electrical contact with the FPC portions of the motherboard connector.

DETAILED DESCRIPTION

Reference will now be made in detail to some embodiments of the invention, examples of which are illustrated in the accompanying drawings.

Figure 14:
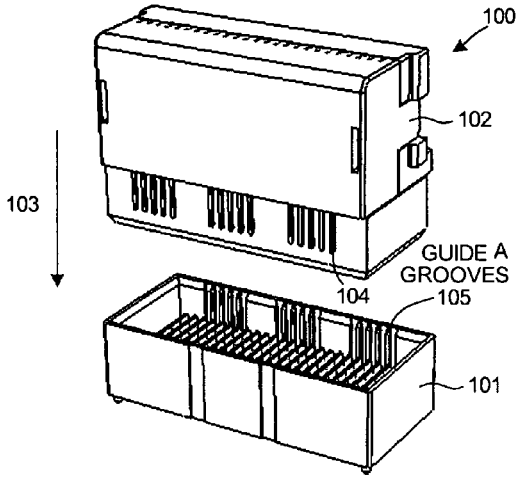
FIG. 14 is a perspective view of a connector assembly in accordance with one novel aspect.

FIG. 14 is a perspective view of a right angle connector assembly 100 in accordance with one novel embodiment. Connector assembly 100 includes a first connector 101 and a second connector 102. First connector 101 may, for example, be attached to a motherboard printed circuit board whereas second connector 102 may be attached to a daughterboard printed circuit board. First connector 101 is therefore hereinafter referred to as a motherboard connector and second connector 102 is hereinafter referred to as a daughterboard connector. To couple the two connectors 101 and 102 together, the second connector 102 may be moved in the direction of arrow 103 with respect to connector 101.

Figure 15:
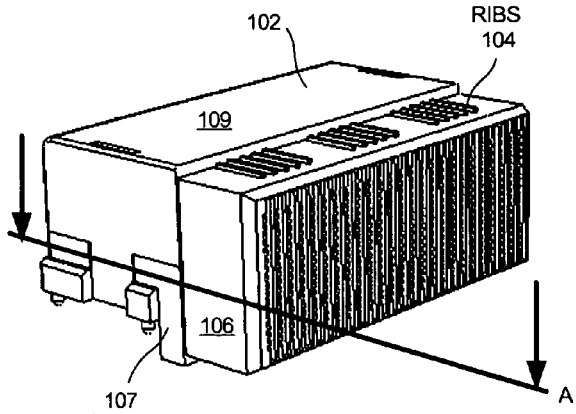
FIG. 15 is a perspective view of the daughterboard connector of the assembly of FIG. 14.

FIG. 15 is a perspective view of daughterboard connector 102. Ribs 104 of connector 102 slidingly engage corresponding guide groves 105 in connector 101 when the two connectors 101 and 102 engage one another.

Figure 16:
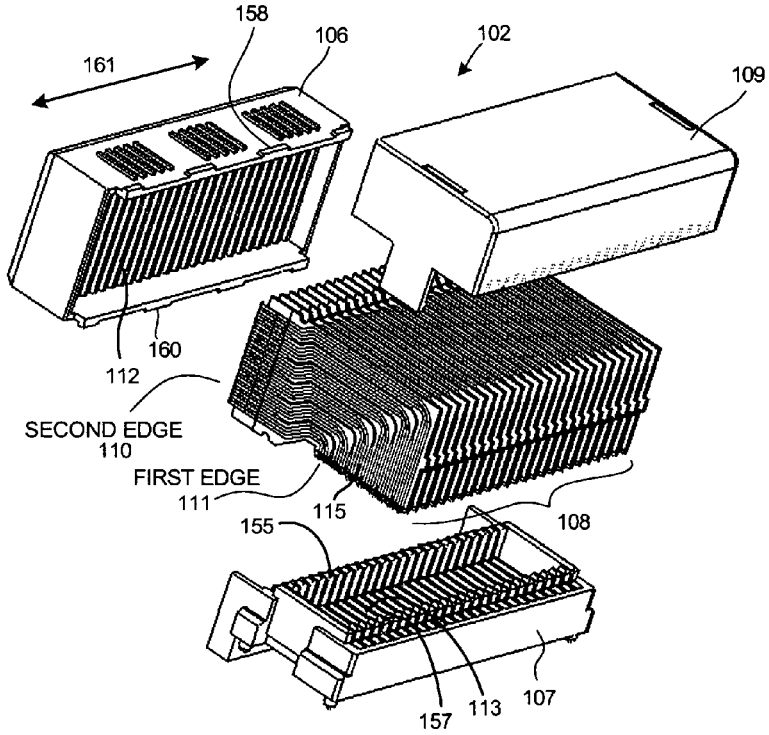
FIG. 16 is an exploded view of the daughterboard connector of FIG. 15 showing its constituent parts.

FIG. 16 is an exploded perspective view of connector 102. Connector 102 includes a first insulative head housing portion 106, second insulative body housing portion 107, a plurality of flexible printed circuit board portions (FPC portions) 108, and a third insulative cap housing portion 109. In one example, the insulated housing portions are made of Liquid Crystal Polymer (LCP) material that has a stable dielectric constant of approximately 3.5 to 4.0 and exhibits small mold shrinkage characteristics.

Each FPC portion includes a plurality of thin signal conductors disposed on a flexible insulative substrate. FPC portion 115 is the foremost FPC portion seen in FIG. 16. A main material of which printed circuit boards are customarily made is FR4 laminate. "FR" means flame retardant, and "4" indicates a woven glass reinforced epoxy resin. The FR4 material is made from glass fabric impregnated with epoxy resin and copper foil. The copper foil is usually formed by electrodeposition. This FR4 material is relatively stiff and has a tensile modulus of approximately eight to nine gigapascals (8.0–9.0 GPa). (The higher the tensile modulus value, the stiffer the material.)

Unlike an ordinary printed circuit board made of FR4, each FPC portion of daughterboard connector 102 is more flexible than an ordinary printed circuit board. Each FPC portion may, for example, have a tensile modulus of less than five GPa. In one embodiment the FPC portions have a tensile modulus in the range of from approximately 2.5 to 3.5 GPa. The FPC portions are flexible printed circuits where the conductors of the FPC portion are carried on a dielectric substrate layer. The dielectric substrate layer may, for example, be a polyimide layer (KAPTON®), a polyester layer (MYLAR®), or a TEFLON® layer. Each conductor of the FPC portion may, for example, be a 0.018 millimeter thick layer of copper or copper alloy.

A first end of each signal conductor terminates in solder ball pad. In the illustration of FIG. 16, the solder ball pads of FPC portion 115 are disposed along a first horizontal bottom edge 111 of FPC portion 115. A second end of each signal conductor terminates in a contact beam. In the illustration of FIG. 16, the contact beams of FPC portion 115 are disposed along a second vertical side edge 110 of FPC portion 115. When assembled, second edge 110 and its contact beams extend into slit-shaped, vertically oriented slot openings 112 in the face of first head housing portion 106. First edge 111 and its solder ball pads extend downward into slit-shaped, horizontally oriented slot openings 113 in the bottom of second housing portion 107. The FPCs and the first, second and third housing portions are formed such that the housing portions hold the FPCs in place and such that the third housing portion 109 snap fits onto the second body housing portion 107.

Figure 17:
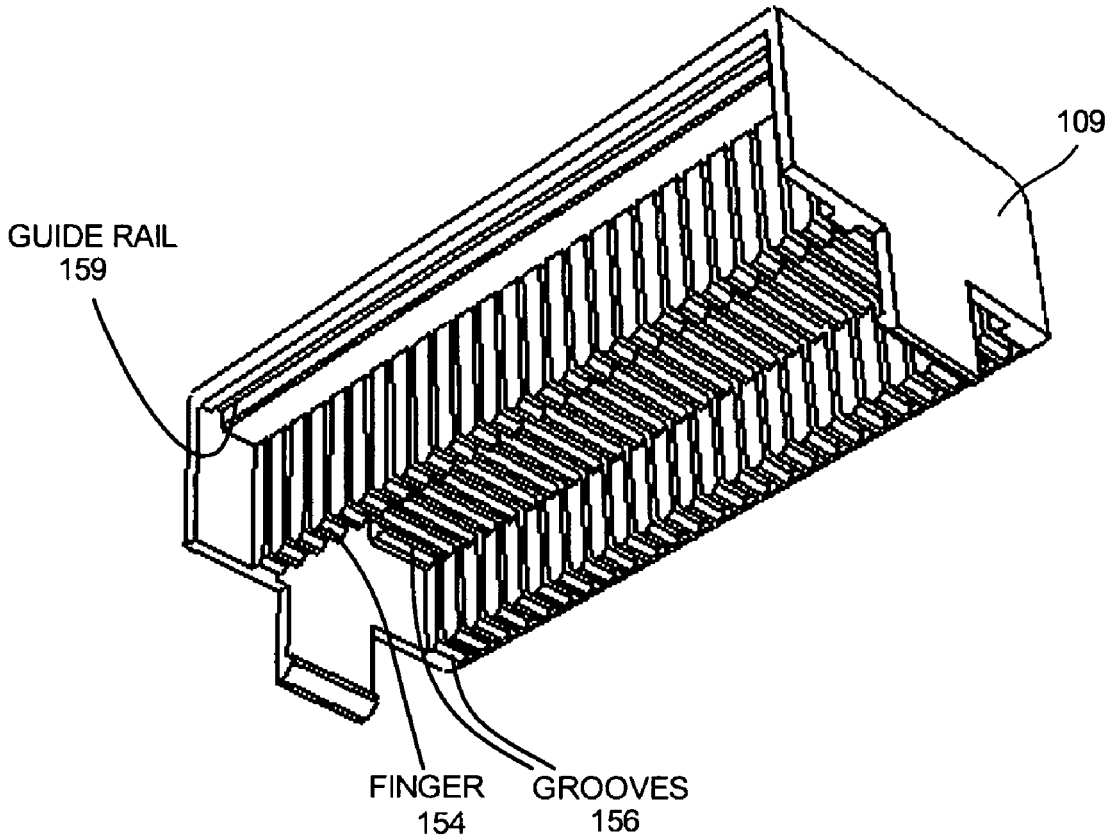
FIG. 17 is a perspective view of the inside of third housing portion 109 of FIG. 16.

FIG. 17 is a perspective view of third housing portion 109. A comb of fingers 154 is seen extending downward from the inside ceiling of third housing portion 109. A corresponding comb of fingers 155 is seen extending upward from the inside floor of second housing portion 107. Each finger extending downward from the ceiling of third housing portion 109 makes contact with a corresponding finger extending upward from the floor of the second housing portion 107 so that the two fingers form an insulative rib that separates adjacent ones of the FPC portions 108. There are grooves 156 in the ceiling surface and back inside surface of the third housing portion 109. These grooves 156 together with fingers 154 hold the FPC portions 108 aligned in parallel with respect to one another. Similarly, there are grooves 157 in the inside back surface of second housing portion 107. These grooves 157 together with fingers 155 and openings 113 hold the FPC portions 108 aligned in parallel with respect to one another.

When the first head housing portion 106, second body housing portion 107, third cap housing portion 109, and FPC portions 108 are assembled together to form daughterboard connector 102, extensions 158 on first head housing portion 106 slidably engage guide rails 159 on the inside of third cap housing portion 109. There are similar extensions 160 that engage guide rails (not shown) on the inside of second insulative body housing portion 107. The extensions and guide rails allow first head housing portion 106 to slide back and forth laterally in the direction of arrow 161. The head portion 106 is therefore said to be laterally displaceable.

Figure 18:
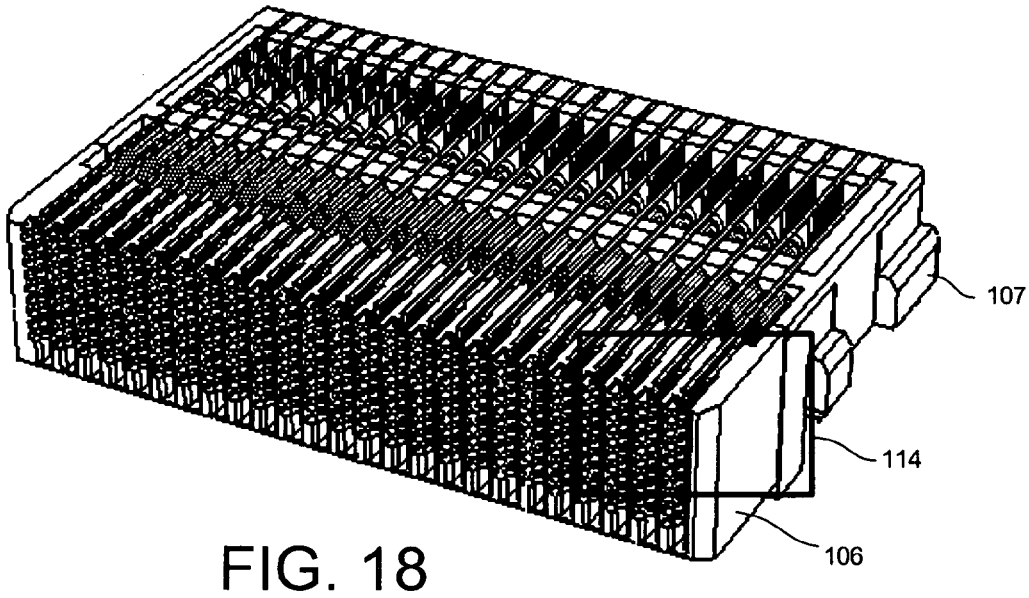
FIG. 18 is a cross-sectional view of the daughterboard connector of FIG. 15 taken along sectional line A—A.

FIG. 18 is a cross-sectional perspective view taken along sectional line A—A in FIG. 15. The perspective view shows the FPC portions disposed in parallel with one another.

Figure 19:
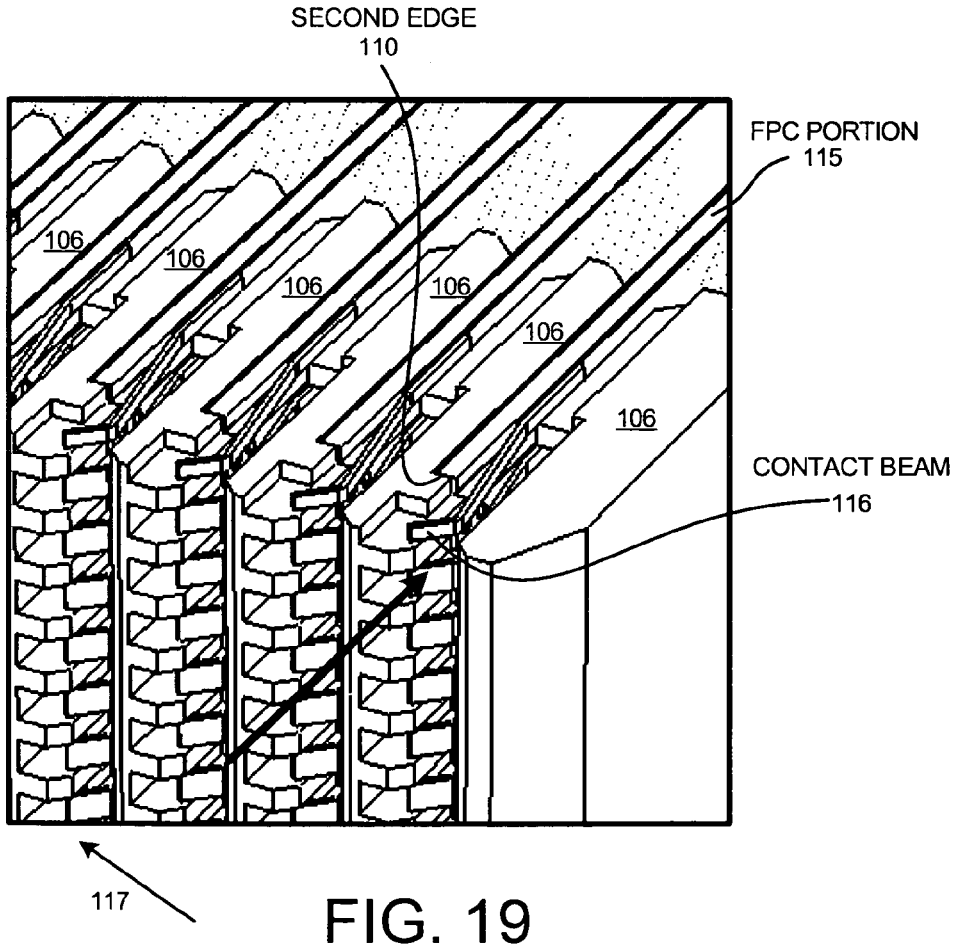
FIG. 19 is an expanded view of a portion of FIG. 18.

FIG. 19 is an expanded view of the portion within box 114 in FIG. 18. Exemplary FPC portion 115, is shown with its vertical second edge 110 inserted into the slit-shaped opening within first housing portion 106. A contact beam 116 is soldered to a signal conductor of FPC portion 115. Contact beam 116 can flex in the direction of arrow 117 if another FPC were forced in the direction of arrow 118 and into connector 102.

Figure 20:
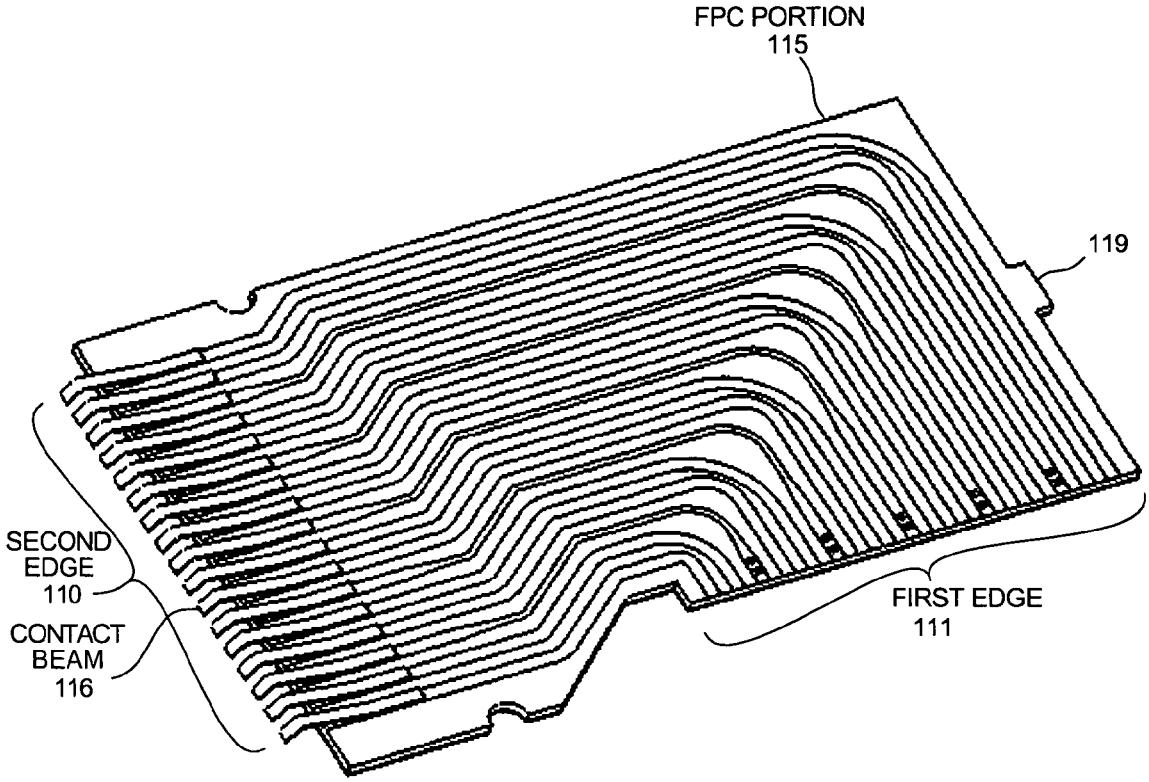
FIG. 20 is a perspective view of a flexible printed circuit board (FPC) portion of the daughterboard connector of FIG. 16.

FIG. 20 is a larger perspective view of FPC portion 115. Solder ball pads are disposed along horizontal first edge 111. A solder ball pad is a site on a signal conductor of FPC 115 to which a solder ball can be attached. Contact beams (such as contact beam 116) are disposed along vertical second edge 110. Tab 119 fits into a receiving slit in third housing portion 109.

Figure 21:
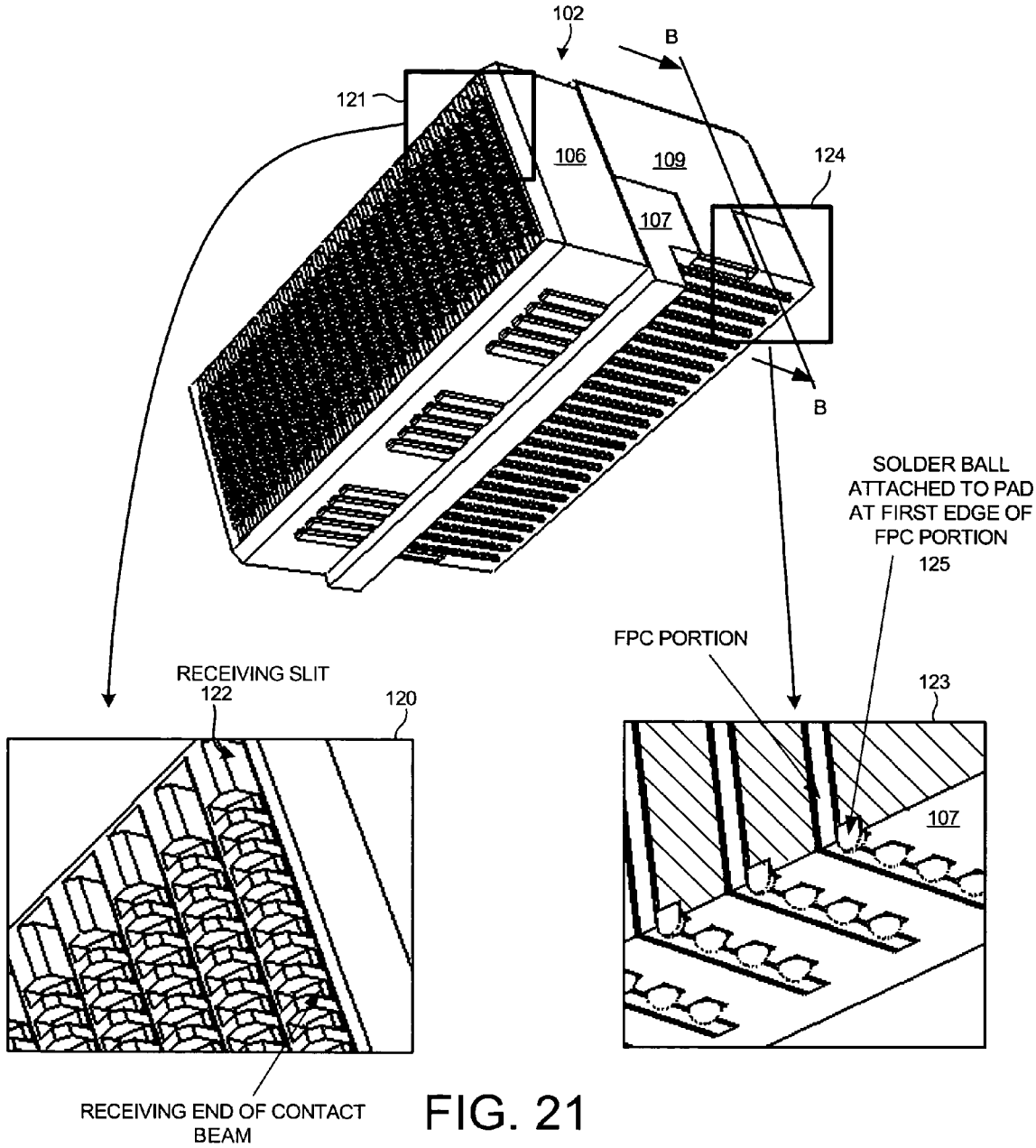
FIG. 21 is a perspective view of the bottom surface mount surface of the daughterboard connector of FIG. 15.

FIG. 21 is an enlarged exploded perspective view of connector 102. There is a plurality of receiving slits in the face of first housing portion 106. The receiving slits are oriented parallel to one another.

Box 120 is an expanded view of the detail of the portion of the face of connector 102 within box 121. The contact beams of each FPC portion are seen on end disposed in a column along the edge of a receiving slit 122.

Box 123 is an expanded view of the detail of the portion of the bottom of connector 102 within box 124. The view of box 123 is a cross-sectional view taken along line B—B. A row of solder balls 125 is seen attached to solder ball pads along the bottom first edge of each FPC portion. The solder balls extend downward past the bottom surface of insulative housing portion 107.

Connector 102 is manufactured by pushing the first edges of the FPC portions through slits or openings 113 in the bottom of housing portion 107 such that the solder ball pads on the first edges of the FPC portions are exposed in openings when housing portion 107 is viewed from below. Solder paste is applied to the pads. A ball of solder is then placed in each opening. The entire structure is then heated so that the solder balls are soldered to the solder pads while the FPC portions are disposed in their corresponding slits in housing portion 107. Housing portion 106 is placed over the second edges of the FPC portions such that the extensions on housing portion 106 fit into the guide rails on housing portion 107. Housing portion 109 is then slid down over the upward extending FPC portions so that the downward extending fingers on the inside of housing portion 159 slide down between adjacent FPC portions. The upward facing extensions 158 on housing portion 106 fit into a guide rail on the inside ceiling of housing portion 109. A retaining latch on housing portion 109 clips down and over an edge on housing 107, thereby fixing housing portion 109 in place to housing portion 107. Housing portion 106 is prevented from falling off due to the extensions on housing portion 106 being retained by the guide rails of housing portions 107 and 109.

Figure 22:
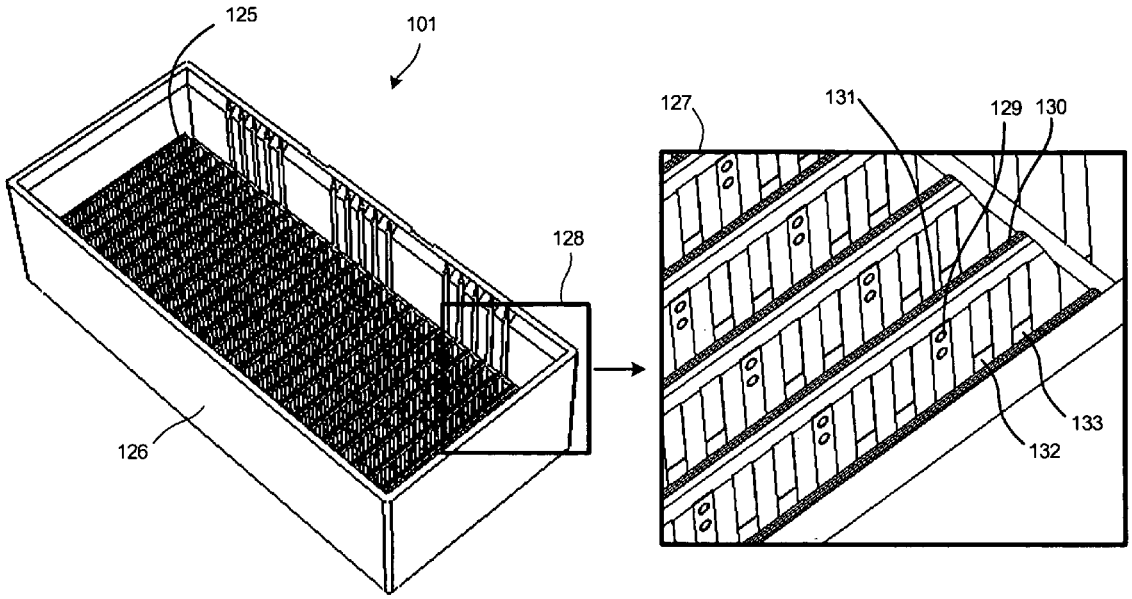
FIG. 22 is a perspective view looking into the motherboard connector of FIG. 14.

FIG. 22 is a top-down perspective view of the inside of motherboard connector 101. Multiple flexible printed circuit board (FPC) portions 125 are disposed parallel to one anther. Each FPC portion 125 is held in place by receiving grooves in the inside sidewall of insulative housing portion 126. Box 127 is an expanded view of the portion of motherboard connector 101 within box 128. Each FPC portion 125 of motherboard connector 101 includes ground conductors and signal conductors disposed on a flexible insulative substrate. Ground conductor 129 is one such ground conductor. Although each of conductors 132, 133 and 129 extends upward to locations proximate to second edge 130, ground conductor 129 extends upward toward second edge 130 farther than do signal conductors 132 and 133.

Figure 23:
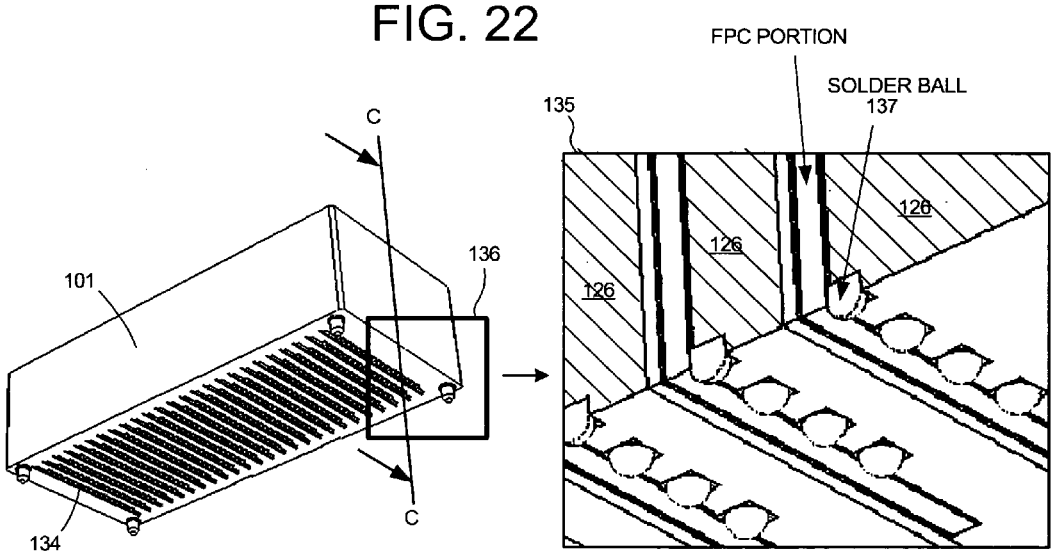
FIG. 23 is a perspective view of the bottom surface mount portion of the motherboard connector of FIG. 14.

FIG. 23 is a perspective view of the bottom surface 134 (the surface that lies adjacent to the motherboard printed circuit board) of motherboard connector 101. Box 135 is an expanded view of the portion of motherboard connector 101 within box 136. Box 135 illustrates a cross-section of motherboard connector 101 taken along line C—C of FIG. 23. A row of solder balls 137 is seen attached to solder ball pads along the bottom first edge of each FPC portion. The solder balls extend downward past the bottom surface 134 of insulative housing portion 126.

Connector 101 is manufactured by pushing the first edges of the FPC portions through slits 138 in the bottom of housing 126 such that the solder ball pads on the first edges of the FPC portions are exposed in openings when housing 126 is viewed from below. Solder paste is applied to the pads. A ball of solder is then placed in each opening. The entire structure is then heated so that the solder balls are soldered to the solder pads while the FPC portions are disposed in their corresponding slits in housing 126.

Figure 24:
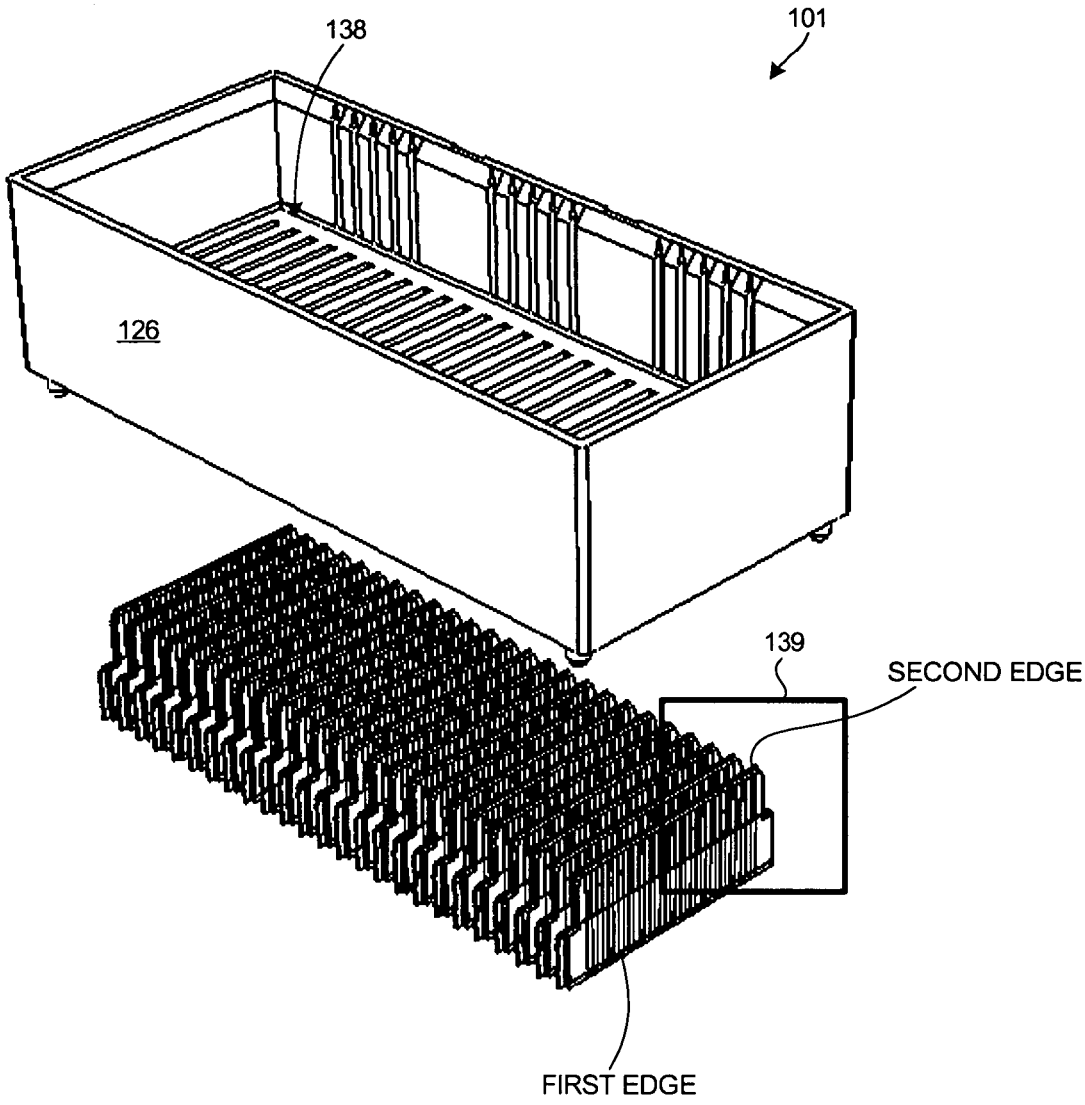
FIG. 24 is an exploded view of the motherboard connector of FIG. 14.

FIG. 24 is an exploded perspective view of motherboard connector 101. The upper second edges of the FPC portions extend upward through corresponding slits 138 in the bottom of insulative housing portion 126. In this example, the FPC portions are made of the same FPC material as are the FPC portions of connector 102. The dielectric thicknesses and dimensions and spacings of the conductors within the FPC portions in connector 101 are identical to the dielectric thicknesses and dimensions and spacings of the conductors with the FPC portions in connector 102 so that the characteristic impedance through the FPC portions of connector 101 will be the same as the characteristic impedance through the FPC portions of connector 102. The characteristic impedance of each signal path through connector assembly 100 from the surface mount attachment solder balls on connector 102 to the surface mount attachment solder balls on connector 101 varies by less than plus or minus ten percent.

Figure 25:
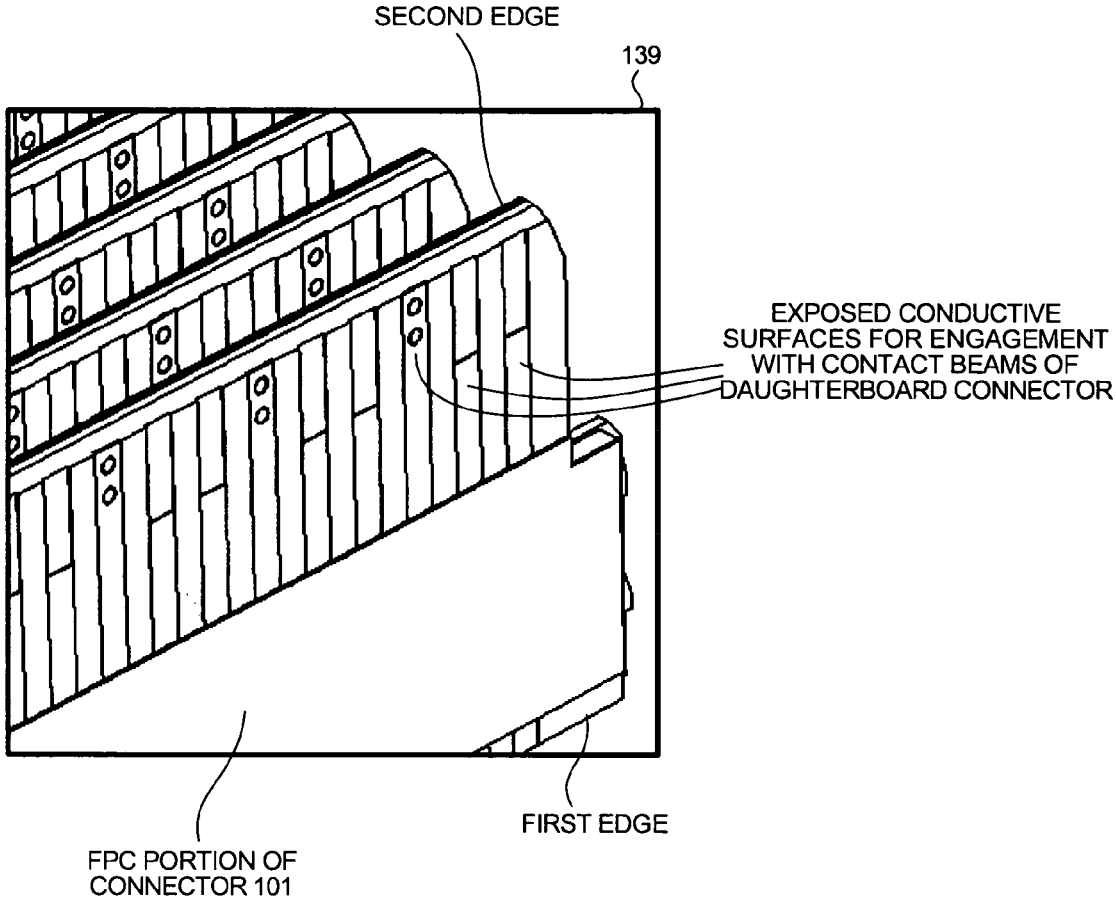
FIG. 25 is an expanded perspective view of a portion of the FPC portions of FIG. 24.

FIG. 25 is an expanded view of the portion of motherboard connector 101 within box 139 of FIG. 24. The upper second edges of the FPC portions are seen. There are multiple sets of conductors on each FPC portion. Each set includes one ground conductor and two signal conductors. A ground plane that is coupled to the ground conductor is disposed in the FPC portion in a plane behind the signal conductors.

Figure 26:
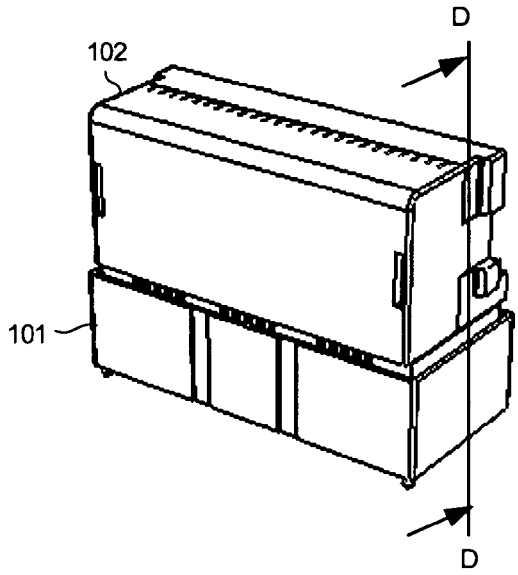
FIG. 26 is a perspective view of the connector assembly of FIG. 14 when the daughterboard connector is mated to the motherboard connector.

FIG. 26 is a perspective view showing daughterboard connector 102 coupled to motherboard connector 101.

Figure 27:
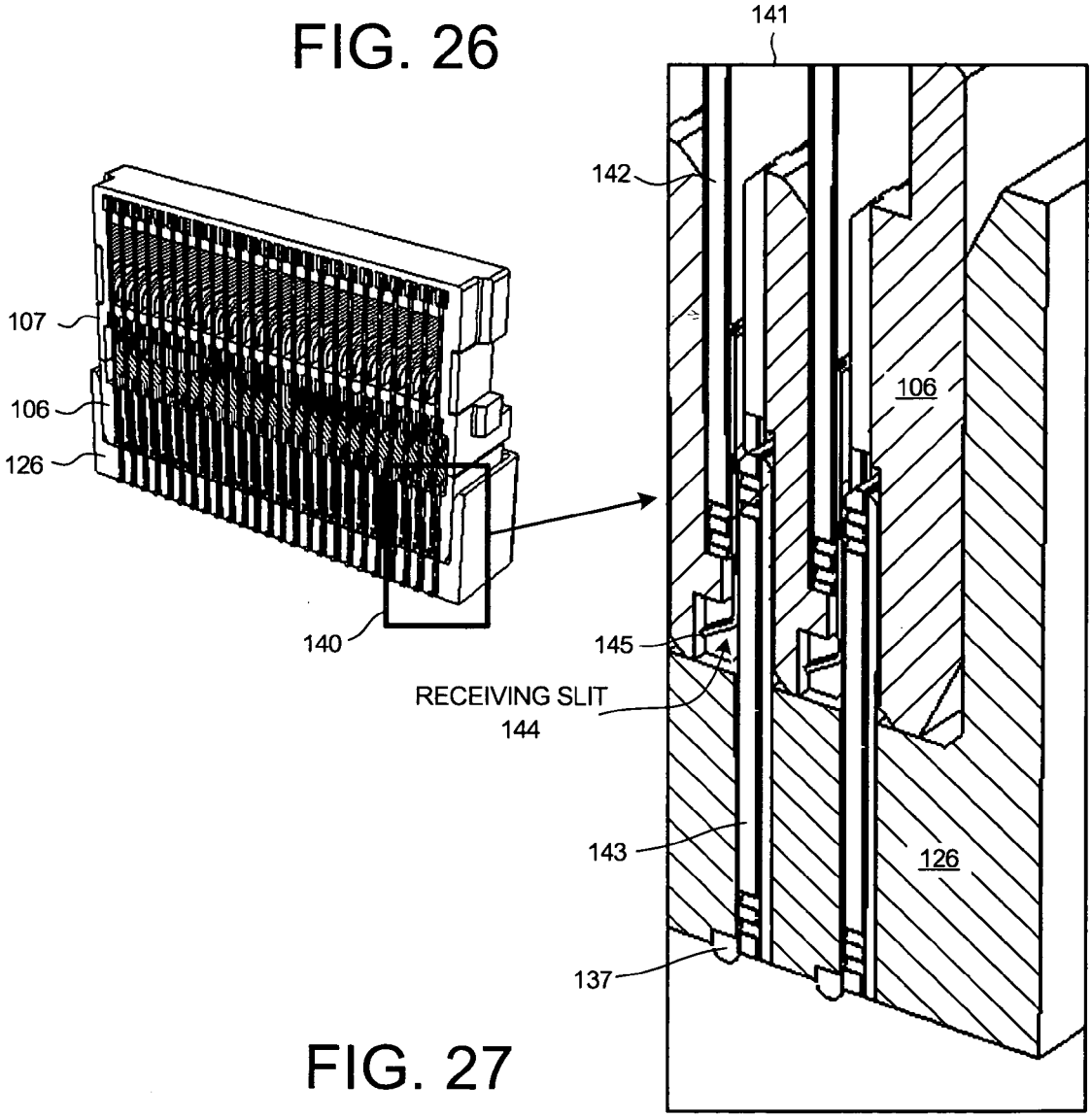
FIG. 27 is a cross-sectional side view taken along sectional line D—D of FIG. 26.

FIG. 27 is a cross-sectional view taken along line D—D in FIG. 26. The portion within box 140 is shown expanded in box 141. For each FPC portion in daughterboard connector 102 there is an associated FPC portion in motherboard connector 101. FPC portion 142 is one such daughterboard connector FPC portion and FPC 143 is one such motherboard connector FPC portion. To connect the two connectors 101 and 102 together, the upward facing second edge of FPC portion 143 is forced into receiving slit 144 in the face of daughterboard connector 102. This is usually accomplished by pushing second connector 102 into first connector 102. Contact beam 145 in second connector 102 flexes as second edge of FPC portion 143 moves into the receiving slit 144 and past the contact beam. Contact beam 145 pushes back against FPC portion 143 so as to provide electrical contact between a conductor in FPC portion 143 and a conductor within FPC portion 142.

Figure 28:
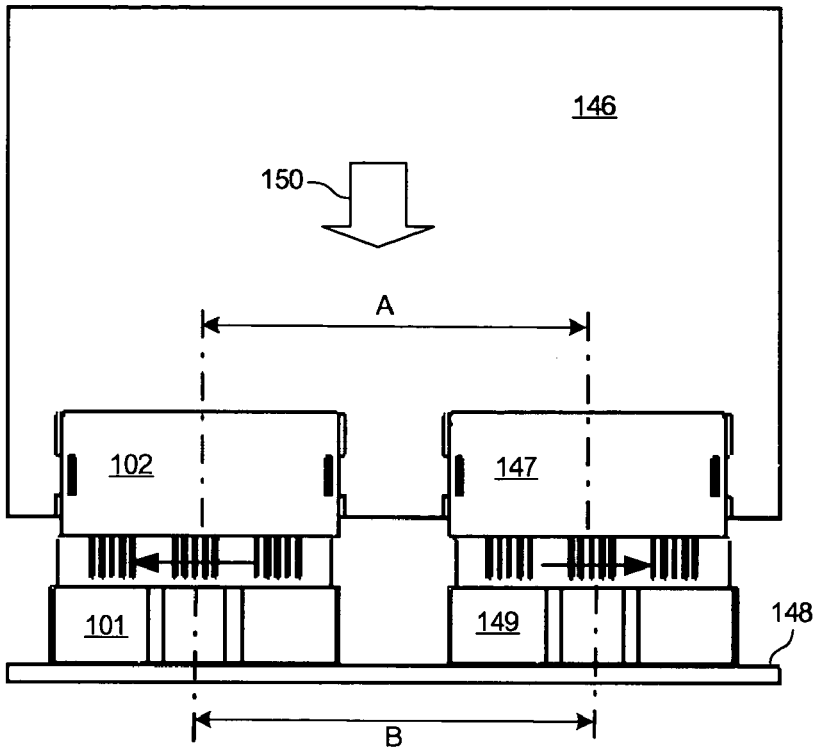
FIG. 28 is a side view showing two connector assemblies in accordance with a novel aspect, where the connector assemblies flex and distend to absorb a misalignment between the connectors connected to the daughterboard and the connectors connected to the motherboard.

FIG. 28 is a view that illustrates a daughterboard printed circuit board 146 upon which two daughterboard connectors 102 and 147 are attached. The daughterboard connectors 102 and 147 are surface mounted by soldering the solder balls of the daughterboard connectors to corresponding solder pads (now shown) on the printed circuit board 146.

Figure 1:
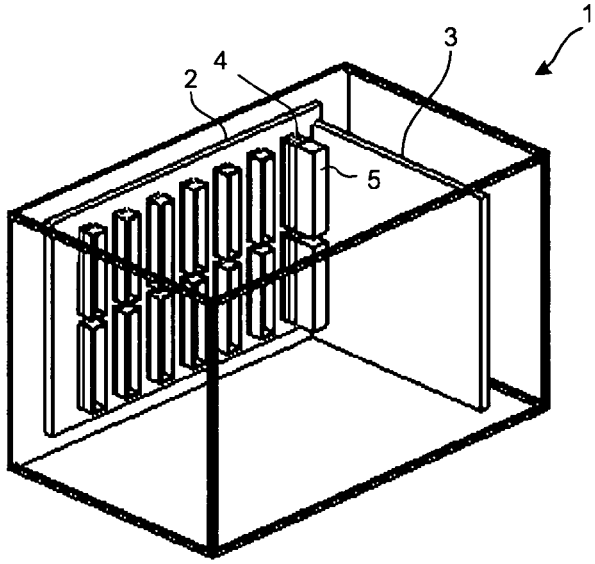
FIG. 1 PRIOR ART
FIG. 1 (Prior Art) is a perspective view of a piece of electronic equipment within which a connector assembly is disposed.
Figure 2:
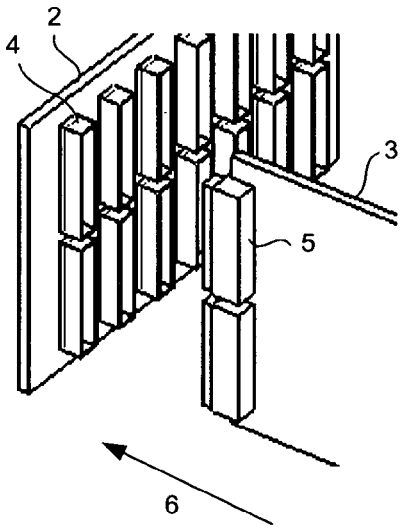
FIG. 2 PRIOR ART
FIG. 2 (Prior Art) is a perspective view showing the connectors on the motherboard and daughterboard in the piece of electronic equipment of FIG. 1.
Figure 3:
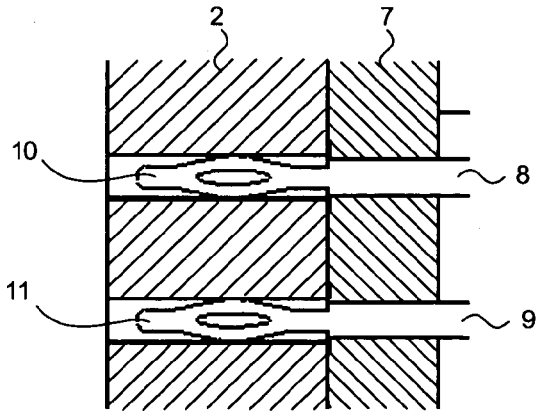
FIG. 3 PRIOR ART
FIG. 3 (Prior Art) is a cross-sectional diagram showing how the motherboard connector of FIGS. 1 and 2 is attached to the motherboard.
Figure 4:
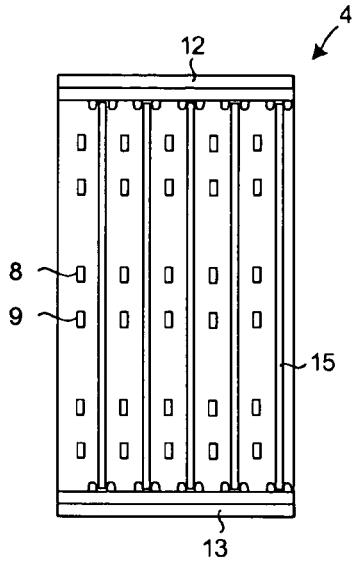
FIG. 4 PRIOR ART
FIG. 4 (Prior Art) is an end view of the motherboard connector of FIGS. 1–3.
Figure 5:
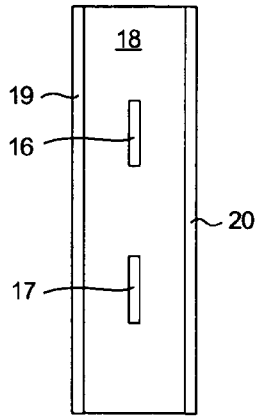
FIG. 5 PRIOR ART
FIG. 5 (Prior Art) is a diagram of a coupled stripline transmission line structure.
Figure 6:
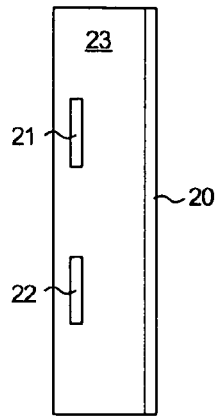
FIG. 6 PRIOR ART
FIG. 6 (Prior Art) is a diagram of a microstrip transmission line structure.
Figure 7:
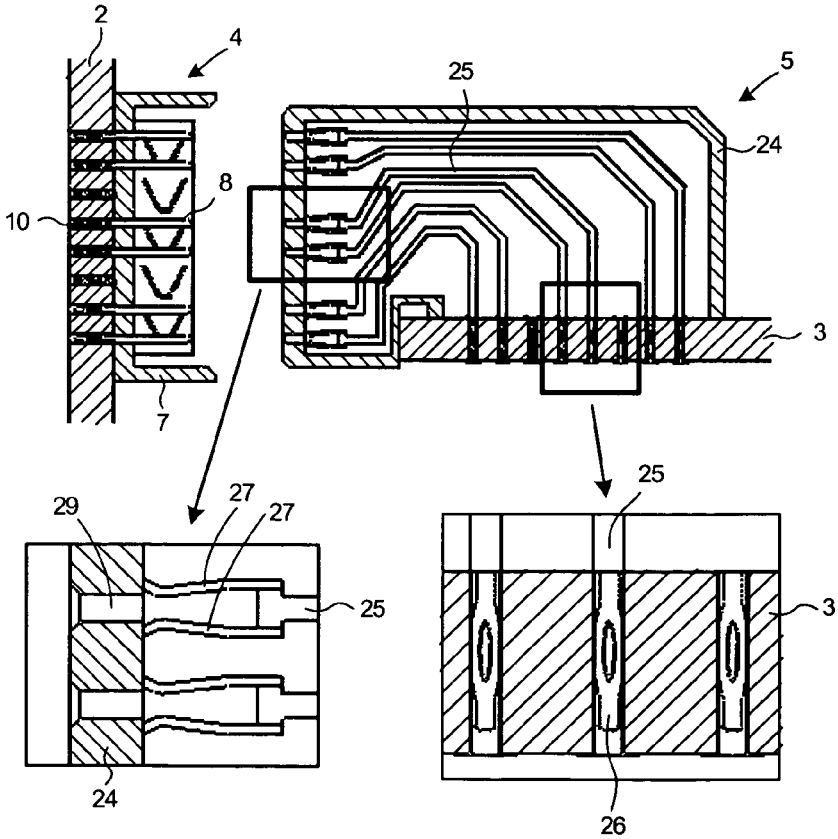
FIG. 7 PRIOR ART
FIG. 7 (Prior Art) is a cross-sectional side view of the motherboard connector and the daughterboard connector of the connector assembly of FIGS. 1–4.
Figure 8:
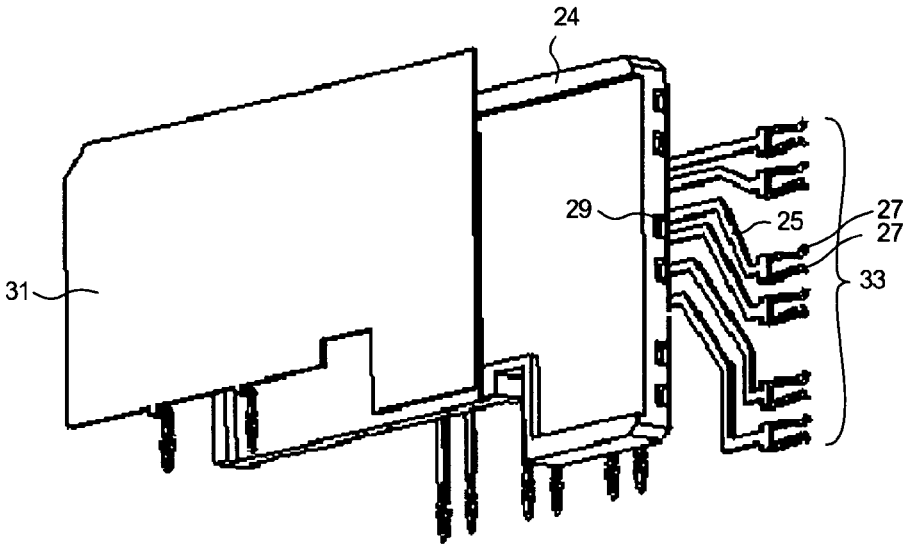
FIG. 8 PRIOR ART
FIG. 8 (Prior Art) is an expanded exploded perspective view of a wafer of the daughterboard connector of FIG. 7.
Figure 9:
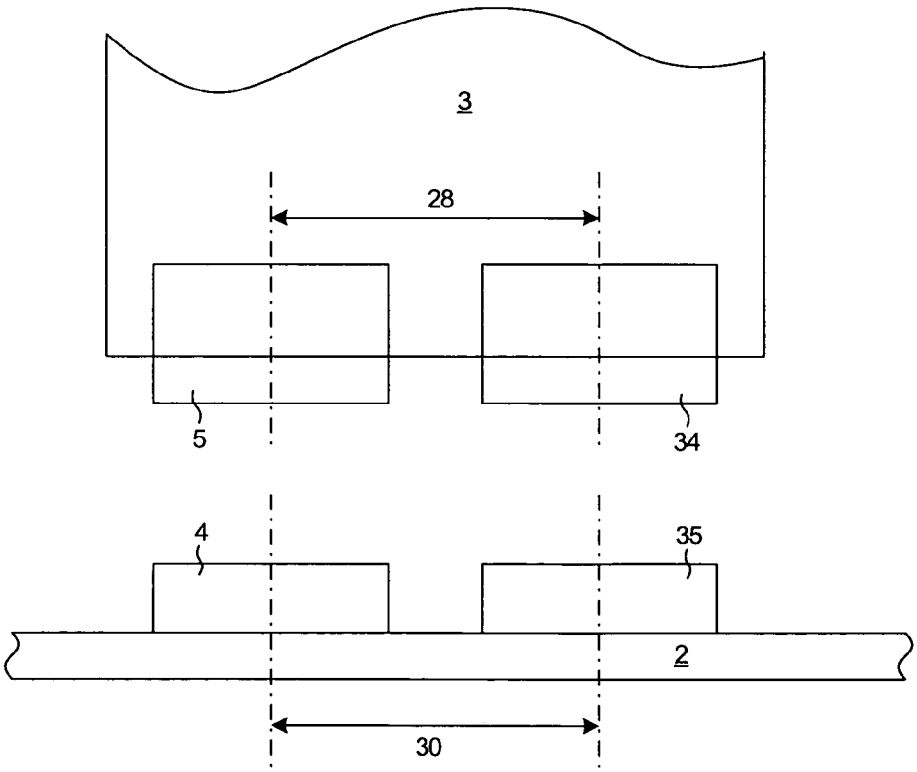
FIG. 9 PRIOR ART
FIG. 9 (Prior Art) is a simplified side view that illustrates stress imposed on the connectors of the connector assembly due to misalignment of the connectors.
Figure 10:
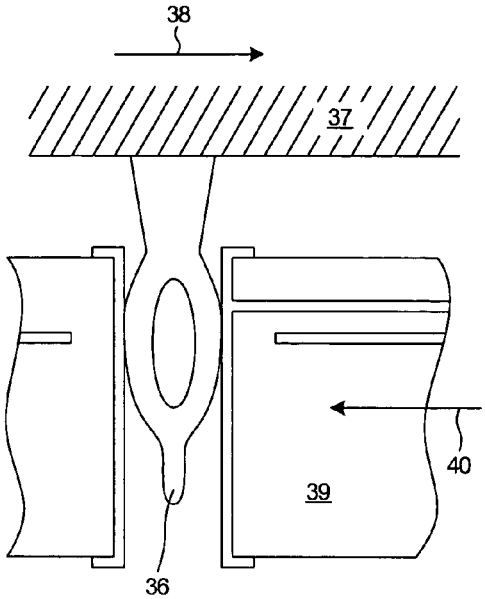
FIG. 10 PRIOR ART
FIG. 10 (Prior Art) is a cross-sectional side view showing a pin and its press-fit contact tail extending into a through hole in a printed circuit board.
Figure 11:
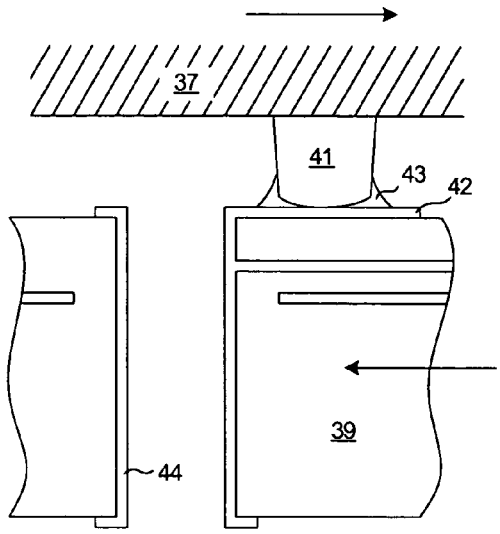
FIG. 11 PRIOR ART
FIG. 11 (Prior Art) is a cross-sectional side view showing a surface mount solder attachment by which a connector can be connected to a printed circuit board.
Figure 12:
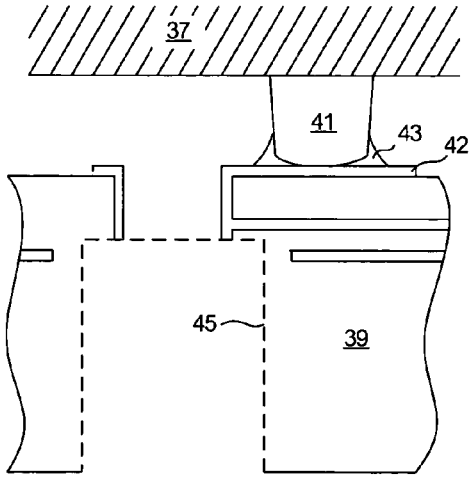
FIG. 12 PRIOR ART
FIG. 12 (Prior Art) is a cross-sectional side view of the surface mount attachment of FIG. 11, but where an extending portion of the plated through hole has been removed in a back drilling step.
Figure 13:
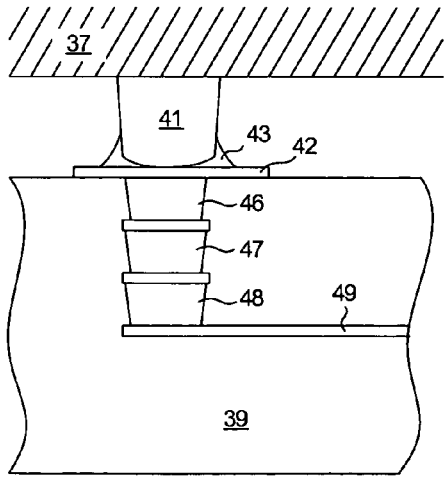
FIG. 13 PRIOR ART
FIG. 13 (Prior Art) is a cross-sectional side view of a stacked blind via structure within the printed circuit board that facilitates surface mount connection of the connector to the printed circuit board without a radiating extra portion of plated through hole.

A motherboard printed circuit board 148 is also illustrated. Motherboard 148 has two motherboard connectors 101 and 149 surface mounted to it. Motherboard connectors 101 and 149 are likewise surface mounted by soldering the solder balls of the motherboard connectors 101 and 149 to corresponding solder pads (not shown) on printed circuit board 148. The surface mount attachment structure of any one of FIGS. 11–13 can be employed. Due to misalignments (for example, due to imperfections in the printed circuit board manufacturing process) between dimension A between connectors 102 and 147 and dimension B between connectors 101 and 149, there may be a stress imposed on the connectors when the printed circuit boards 146 and 148 are brought together (the direction of arrow 150) when corresponding daughterboard and motherboard connectors are fit together.

Figure 29:
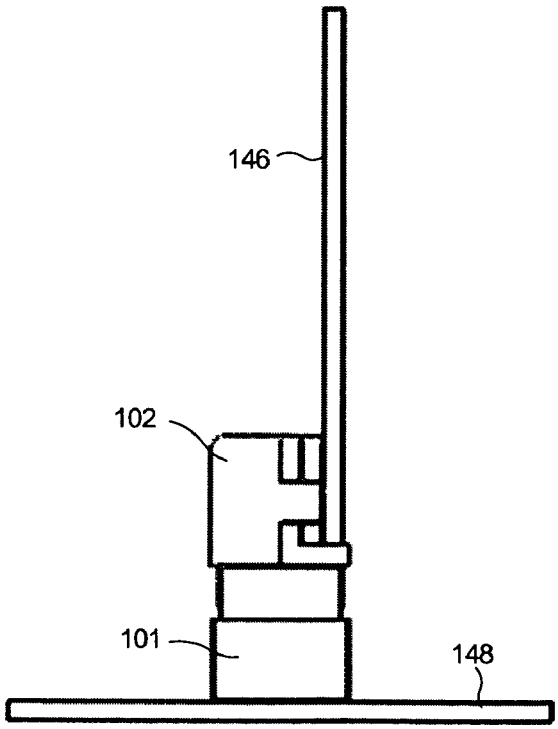
FIG. 29 is an end view of the structure of FIG. 28.

FIG. 29 is an end view of the structure of FIG. 28. In accordance with a novel aspect, FPC portions 108 flex within the daughterboard connector 102 of the connector assembly.

Figure 30:
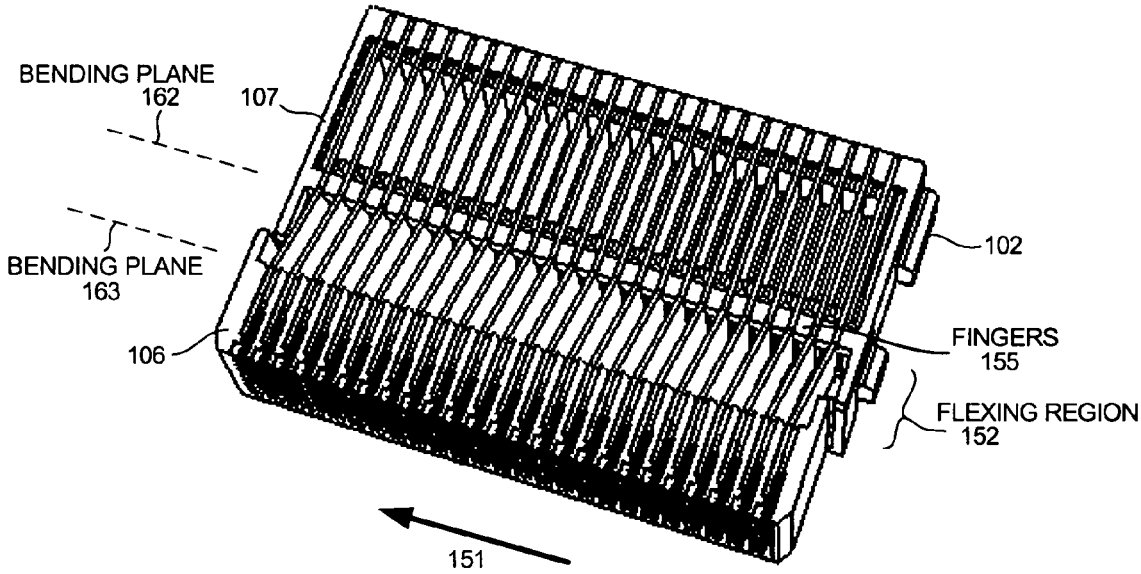
FIG. 30 is a cross-sectional view of the daughterboard connector 102 when its constituent FPC portions are bent in the flexing region of the daughterboard connector when head portion 106 is pushed in the direction of arrow 151 with respect to body portion 107.

FIG. 30 is a sectional view of daughterboard connector 102 wherein housing portion 106 is deflected a distance to the left in the direction of arrow 151 with respect to housing portion 107. The FPC portions of daughterboard connector 102 are flexed in flexing region 152 of the connector. Adjacent FPC portions are separated from one another at the flexing boundary plane 162 of flexing region 152 by fingers 155.

Figure 31:
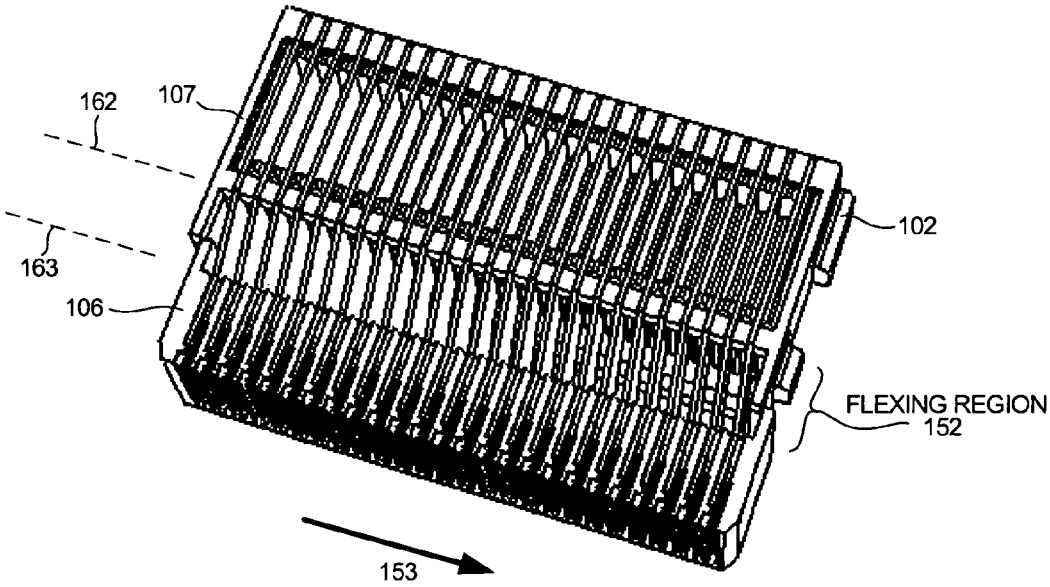
FIG. 31 is a cross-sectional view of the daughterboard connector 102 when its constituent FPC portions are bent in the flexing region of the daughterboard connector when head portion 106 is pushed in the direction of arrow 153 with respect to body portion 107.

FIG. 31 is a sectional view of daughterboard connector 102 wherein housing portion 106 is deflected a distance to the right in the direction of arrow 153 with respect to housing portion 107. The FPC portions of daughterboard connector 102 are flexed in flexing region 152 of the connector. Due to the ability of the connector assembly to flex and accommodate lateral displacement of the daughterboard connector with respect to the motherboard connector, mechanical stress on the surface mount attachment of the connectors to the printed circuit boards is reduced. Due to this reduced stress, surface mount attachment techniques having desirable electrical properties can be employed while at the same time providing adequate reliability of the connector the printed circuit board joints.

Figure 32:
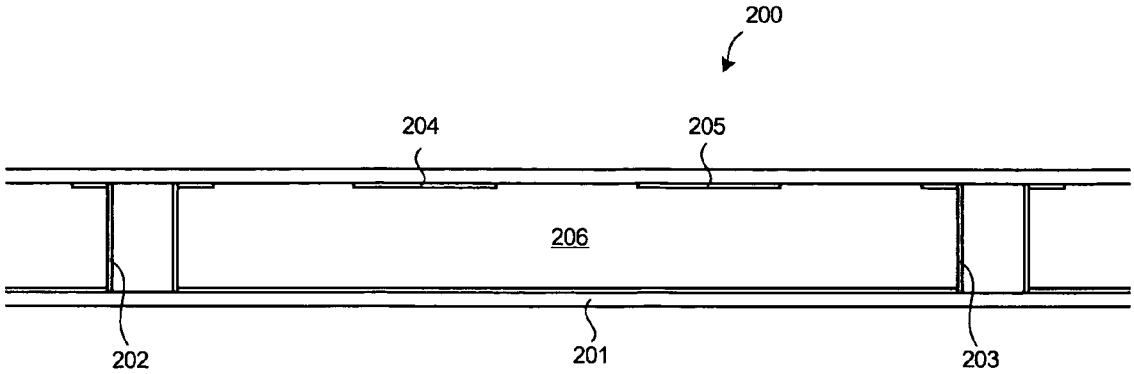
FIG. 32 is a cross-sectional end view of an FPC portion within the connector assembly.

FIG. 32 is a cross-sectional end view of an FPC portion 200 in either the motherboard connector or the daughterboard connector. A ground plane 201 is coupled by conductive vias, plugs or through holes 202 and 203 to the surface of FPC portion 200 upon which a pair of differential signal conductors 204 and 205 is disposed. Material 206 is flexible insulative polyimide material or another flexible insulative material used to make flexible printed circuit boards. The signal conductors 204 and 205 are, in the cross-section illustrated, covered by a solder mask layer. Contact beams (not shown) for ground potential contact the ground pad portions atop or near vias 202 and 203 in situations where the FPC portion is part of a motherboard connector. Contact beams (not shown) for ground potential are fixed to the contact pads atop or near vias 202 and 203 in situations where the FPC portion is part of a daughterboard connector. Note that the ground plane and conductive vias surround the signal conductors on three sides in the view of FIG. 32.

Figure 33:
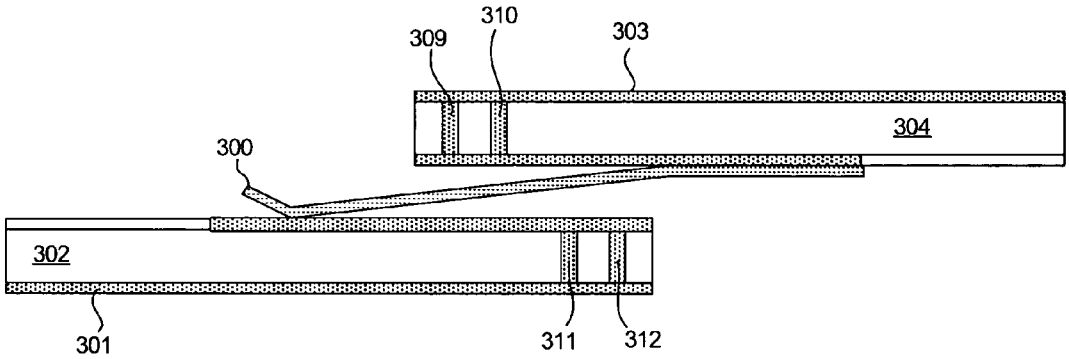
FIG. 33 is a cross-sectional side view that illustrates how a contact beam contacts a ground conductor within an FPC portion of the motherboard connector such that a ground conductor within an FPC portion of the daughterboard connector is connected to a ground conductor within an FPC portion of the motherboard connector.

FIG. 33 is a cross-sectional diagram showing a contact beam 300 that couples ground potential from a ground plane conductor 301 in FPC portion 302 of the motherboard connector 101 to a ground plane conductor 303 in FPC portion 304 of the daughterboard connector 102. A plurality of conductive plated through holes 309–310 are provided to connect the ground plane conductor 303 to a strip of metal on the opposite side of FPC portion 304. Contact beam 300 is connected to this strip of metal. More than one 0.2 millimeter diameter plated through hole is provided to reduce ground current bottlenecks in the ground current path between ground plane conductor 303 and contact beam 300. Similarly, two 0.2 millimeter diameter plated through holes 311 and 312 are provided to reduce ground current bottlenecks in the ground current path between ground plane conductor 301 and contact beam 300.

Figure 34:
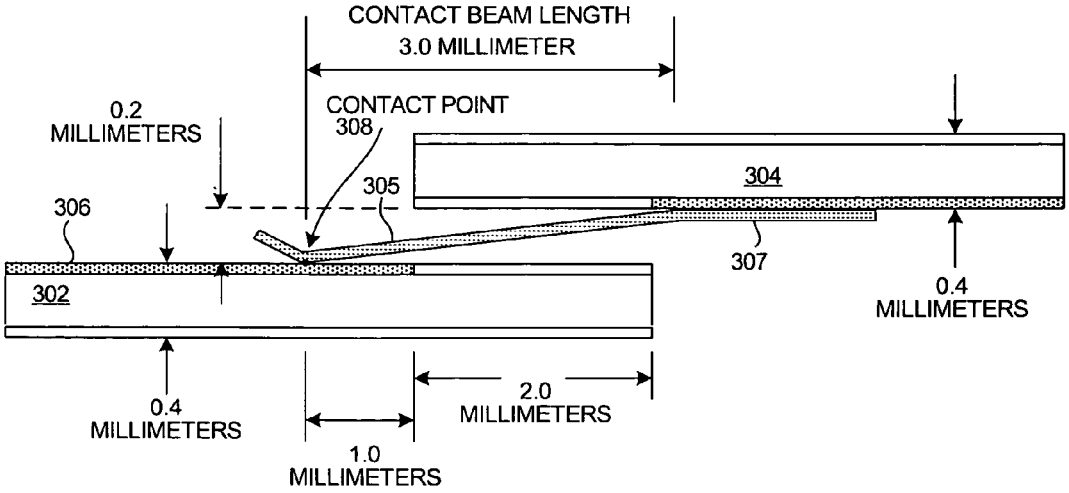
FIG. 34 is a cross-sectional side view that illustrates how a contact beam contacts a signal conductor within an FPC portion of the motherboard connector such that a signal conductor within an FPC portion of the daughterboard connector is connected to a signal conductor within an FPC portion of the motherboard connector.

FIG. 34 is a cross-sectional diagram showing a contact beam 305 that couples a signal from a signal conductor 306 in FPC portion 302 of the motherboard connector 101 to a signal conductor 307 in FPC portion 304 of the daughterboard connector 102. Note that the via and conductor structure of FIG. 33 extends a grounded conductor to the rightmost end of FPC portion 302 in FIG. 33 and also extends a grounded conductor to the leftmost end of FPC portion 304 in FIG. 33. The grounded conductor structure in this area helps shield the area of contact beam 305 of FIG. 34. The grounded conductor structure shown in cross-section in FIG. 33 exists on either side (exists once in a plane behind the plane shown in the illustration of FIG. 34, and exists again in a plane in front of the plane shown in the illustration of FIG. 33) of the signal conductor structure of FIG. 34. The free end of contact beam 305 extends in a direction away from the second edge of FPC 304. Signal conductor 306 in FPC 302 only extends 1.0 millimeters beyond the contact point 308 where contact beam 305 makes contact with signal conductor 306. Contact beam extends to a location proximate to the second edge of FPC 302. The distance (2.0 millimeters) between the end of signal conductor 306 and the second edge should be less than the contact beam length (3.0 millimeters).

Figure 35:
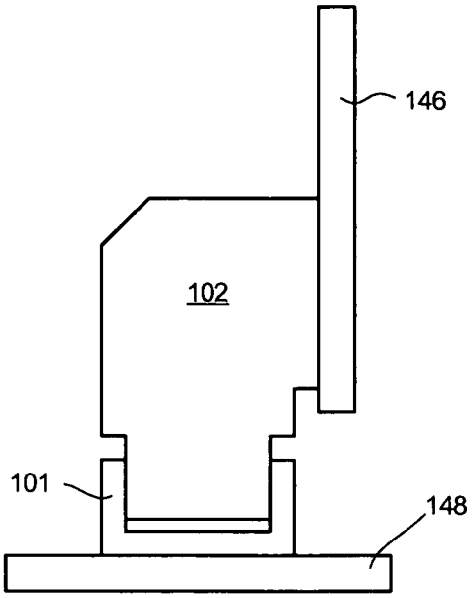
FIG. 35 is a diagram of a right angle version of the novel connector assembly.
Figure 36:
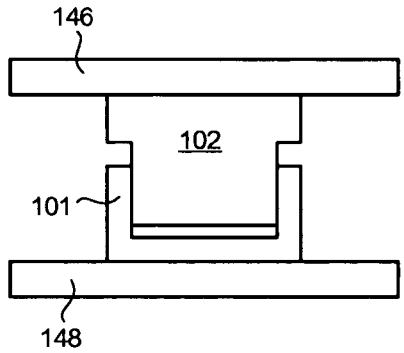
FIG. 36 is a diagram of a stacked version of the novel connector assembly.
Figure 37:
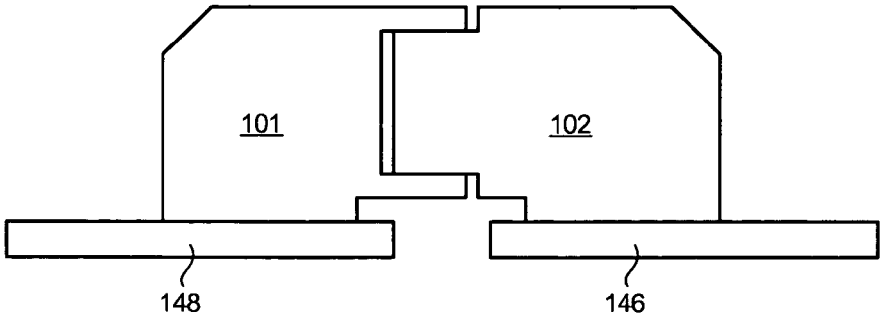
FIG. 37 is a diagram of a side-by-side version of the novel connector assembly.

FIGS. 35–37 illustrate other forms of the connector assembly 100. The connector assembly 100 is shown in FIG. 35 in a right angle configuration connecting motherboard 148 to daughterboard 146. The connector assembly 100 is shown in a parallel (sometimes called stacking) configuration in FIG. 36. In FIG. 36, the connector assembly connects two printed circuit boards 146 and 148 together so that the two printed circuit boards are oriented parallel to one another. FIG. 37 illustrates connector assembly 100 in a horizontal (sometimes called side-by-side) configuration connecting motherboard 148 to daughterboard 146 such that the two printed circuit boards are disposed side by side.

Although the present invention has been described in connection with certain specific embodiments for instructional purposes, the present invention is not limited thereto. Rather than attaching an FPC portion to a printed circuit board using solder balls, metal surface mount contacts can be attached to the FPC portions. To attach a connector using metal surface mount contacts to a printed circuit board, solder paste is applied to solder pads on the printed circuit board and the connector is placed on the printed circuit board such that the metal surface mount contact is in the solder paste. The connector and printed circuit board is then heated so that the solder paste melts and solders the metal surface mount contact of the connector to the solder pad of the printed circuit board. The tensile modulus of the FPC portions of the motherboard connector may be significantly greater (for example, eight GPa or more) than the tensile modulus of the FPC portions of the daughterboard connector (for example, 5.0 GPa or less).

In some embodiments, printed circuit boards are used in place of the FPC portions of the motherboard connector illustrated in FIG. 24. Where flexibility is not required in the connector assembly, printed circuit boards can be used in place of the FPC portions in both the motherboard and daughterboard connectors. Rather than using a flexible printed circuit in the connector with the laterally displaceable head portion, conductors that are stamped out of a sheet of metal can be used. These conductors can be supported by the insulative housing material of one of the connectors in places and not in other places so that they can flex within the connector, thereby preventing the buildup of stress between misaligned connectors of the assembly. Alternatively, the stamped conductors can be attached to or laminated to an insulative substrate layer. The resulting multi-layer structure is then used in place of the FPC portions in the embodiments described above. Rather than using a conductive contact beam to make electric contact between a signal conductor on one FPC portion and a signal conductor of another FPC portion, an insulative spring member can push on the backside of one FPC portion such that a conductor on the other side is forced against a conductor of another FPC portion. Conductors on the printed circuits of the motherboard and daughterboard connectors can be used to communicate single-ended signals, differential signals, and/or a combination of the two. Accordingly, various modifications, adaptations, and combinations of various features of the described embodiments can be practiced without departing from the scope of the invention as set forth in the claims.

What is claimed is:

1. A connector assembly comprising:

a first surface-mount connector comprising an insulative housing and a first printed circuit (PC) portion, the first PC portion having a first edge and a second edge, wherein a set of surface mount attachment structures for coupling the first PC portion to a first printed circuit board is disposed along the first edge, the first PC portion including a first plurality of conductors wherein each conductor of the first plurality of conductors extends from a location proximate to the first edge to a location proximate to the second edge; and a second surface-mount connector comprising an insulative housing and a second PC portion, the second PC portion having a first edge and a second edge, the second PC portion including a second plurality of conductors wherein each conductor of the second plurality of conductors extends from a location proximate to the first edge to a location proximate to the second edge, wherein a set of surface mount attachment structures for coupling the second PC portion to a second printed circuit board is disposed along the first edge, wherein a set of contact beams is disposed along the second edge of the second PC portion, wherein the first surface-mount connector and the second surface-mount connector are mateable such that each contact beam of the second surface-mount connector makes electrical contact with a corresponding one of the first plurality of conductors of the first PC portion, wherein the first PC portion of the first surface-mount connector is parallel to and overlaps at least a portion of the second PC portion of the second surface-mount connector when the first surface-mount connector and the second surface-mount connector are mated.

2. The connector assembly of claim 1, wherein the surface mount attachment structures are taken from the group consisting of: solder balls, and metal surface mount contacts.

3. The connector assembly of claim 1, wherein the first PC portion is a printed circuit board, and wherein the second PC portion is a flexible printed circuit.

4. The connector assembly of claim 1, wherein the first PC portion is a flexible printed circuit, and wherein the second PC portion is a flexible printed circuit.

5. The connector assembly of claim 1, wherein the first PC portion is a printed circuit board, and wherein the second PC portion is a printed circuit board.

6. The connector assembly of claim 1, wherein the insulative housing of the second surface-mount connector comprises:

a body housing portion, wherein the surface mount attachment structures for coupling the second PC portion to the second printed circuit board extend from the body housing portion; and a head housing portion, wherein the second PC portion extends from the surface-mount attachment structures, through at least a portion of the body housing portion, and through at least a portion of the head housing portion, the head housing portion being moveable with respect to the body housing portion such that the second PC portion flexes when the head housing portion moves with respect to the body housing portion.

7. The connector assembly of claim 6, wherein the head housing portion slidably engages the body housing portion.

8. The connector assembly of claim 1, wherein each of the first plurality of conductors is a signal conductor, wherein each of the second plurality of conductors is a signal conductor, and wherein each of the contact beams is connected to one and only one conductor of the second plurality of conductors.

9. The connector assembly of claim 1, wherein the second PC portion has a tensile modulus of less than five GPa.

10. The connector assembly of claim 1, wherein the second surface-mount connector has a head housing portion and a body housing portion, the head housing portion being laterally displaceable with respect to the body housing portion.

11. The connector assembly of claim 1, wherein the first surface-mount connector comprises a plurality of identical PC portions, and wherein the second surface-mount connector comprises a plurality of identical PC portions.

12. The connector assembly of claim 1, wherein the second PC portion comprises:

an insulative layer;

a first conductor disposed on a first side of the insulative layer; and a second conductor disposed on a second side of the insulative layer.

13. A connector assembly, comprising:

a first surface-mount connector comprising an insulative housing and a first printed circuit (PC) portion, the first PC portion having a first edge and a second edge, wherein a set of surface mount attachment structures for coupling the first PC portion to a first printed circuit board is disposed along the first edge, the first PC portion including a first plurality of conductors wherein each conductor of the first plurality of conductors extends from a location proximate to the first edge to a location proximate to the second edge; and a second surface-mount connector comprising an insulative housing and a second PC portion, the second PC portion having a first edge and a second edge, the second PC portion including a second plurality of conductors wherein each conductor of the second plurality of conductors extends from a location proximate to the first edge to a location proximate to the second edge, wherein a set of surface mount attachment structures for coupling the second PC portion to a second printed circuit board is disposed along the first edge, wherein the first surface-mount connector and the second surface-mount connector are mateable such that each conductor of the second plurality of conductors of the second PC portion is put in electrical contact with a corresponding one of the first plurality of conductors of the first PC portion, wherein the first PC portion of the first surface-mount connector is parallel to and overlaps at least a portion of the second PC portion of the second surface-mount connector when the first surface-mount connector and the second surface-mount connector are mated.

14. The connector assembly of claim 13, wherein the second PC portion has a tensile modulus of five GPa or less.

15. The connector assembly of claim 13, wherein a set of conductive paths is formed through the connector assembly, each such conductive path extending from one of the surface mount attachment structures of the first surface-mount connector, through one of the first plurality of conductors of the first PC portion, through one of the second plurality of conductors of the second PC portion, and to one of the surface mount attachment structures of the second connector, and wherein each such conductive path has a characteristic impedance that varies by less than plus or minus ten percent between the surface mount attachment structure of the first surface-mount connector and the surface mount attachment structure of the second surface-mount connector.

16. A method, comprising:

using a first structure to electrically couple a surface mount attachment structure of a first connector to an exposed conductive surface of the first connector, wherein the first structure is part of the first connector; and using a flexible printed circuit to electrically couple a surface mount attachment structure of a second connector to a contact beam, wherein the flexible printed circuit is part of the second connector, wherein the second connector is mateable to the first connector such that the contact beam detachably engages the exposed conductive surface, and wherein the first structure is parallel to and overlaps at least a portion of the flexible printed circuit when the second connector is mated to the first connector, and wherein the second connector includes a head portion and a body portion, the head portion being moveable with respect to the body portion.

17. The method of claim 16, wherein the first structure is a printed circuit, and wherein the exposed conductive surface is a surface of a conductor of the printed circuit.

18. The method of claim 16, wherein the first structure has a first side and a second side, the exposed conductive surface being on the first side, and wherein the second connector includes no conductor that is both electrically coupled to the contact beam and is also in contact with the second side of the first structure.

19. The method of claim 16, wherein the first connector comprises a plurality of printed circuits identical to said first structure, and wherein the second connector comprises a plurality of flexible printed circuits identical to said flexible printed circuit.

20. The method of claim 19, wherein a conductive path is established between the surface mount attachment structure of the first connector and the surface mount attachment structure of the second connector, the conductive path having a characteristic impedance that varies by less than plus or minus ten percent.

* * * * *